US010527342B2

(12) United States Patent
Park

(10) Patent No.: US 10,527,342 B2
(45) Date of Patent: Jan. 7, 2020

(54) REFRIGERATOR AND DOOR OPENING APPARATUS FOR REFRIGERATOR

(71) Applicant: LG Electronics Inc., Seoul (KR)

(72) Inventor: Hyunjin Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/040,740

(22) Filed: Jul. 20, 2018

(65) Prior Publication Data

US 2019/0024965 A1 Jan. 24, 2019

(30) Foreign Application Priority Data

Jul. 21, 2017 (KR) ..... 10-2017-0092824

(51) Int. Cl.

| | |
|---|---|
| ***E05B 1/00*** | (2006.01) |
| ***F25D 23/02*** | (2006.01) |
| ***F24C 15/02*** | (2006.01) |
| ***E05F 1/08*** | (2006.01) |
| ***E05F 11/54*** | (2006.01) |
| ***E05F 11/10*** | (2006.01) |

(52) U.S. Cl.

CPC ..... *F25D 23/028* (2013.01); *E05F 1/08* (2013.01); *E05F 11/10* (2013.01); *E05F 11/54* (2013.01); *E05Y 2201/426* (2013.01); *E05Y 2201/68* (2013.01); *E05Y 2201/686* (2013.01); *E05Y 2900/31* (2013.01)

(58) Field of Classification Search

CPC ..... F25D 23/028; E05B 17/0033; E05F 1/08; E05F 11/10; E05F 11/54

See application file for complete search history.

(56) References Cited

U.S. PATENT DOCUMENTS

| | | | | |
|---|---|---|---|---|
| 6,746,091 | B2 * | 6/2004 | Friar | A61G 12/001 312/218 |
| 6,957,979 | B2 * | 10/2005 | Welsh | H05K 7/1409 439/545 |
| 7,036,499 | B2 * | 5/2006 | Bartmann | E05B 7/00 126/191 |
| 7,261,100 | B2 * | 8/2007 | Bartmann | F24C 15/023 126/192 |
| 7,445,005 | B2 * | 11/2008 | Bartmann | E05B 7/00 126/192 |
| 7,918,492 | B2 * | 4/2011 | Elliott | B60J 5/06 296/146.12 |

(Continued)

FOREIGN PATENT DOCUMENTS

KR 1020120124693 11/2012

*Primary Examiner* — Kimberley S Wright

(74) *Attorney, Agent, or Firm* — Fish & Richardson P.C.

(57) ABSTRACT

Disclosed are a refrigerator and a refrigerator door opening apparatus. The refrigerator includes a cabinet forming a storage space; a door configured to open and close the storage space; a panel installed on a front surface of the door to form an external appearance; a door handle provided in the panel and operable to open the door; and a door opening apparatus coupled to the door handle and configured to assist in opening the door. The door opening apparatus includes a main module installed inside the panel and configured to protrude backward from the panel according to the operation of the door handle; and a sub-module provided at an end portion of the door corresponding to the main module and configured to protrude backward in conjunction with the main module to push the cabinet and open the door.

20 Claims, 15 Drawing Sheets

(56) References Cited

U.S. PATENT DOCUMENTS 8,020,548 B2 * 9/2011 Bartmann ..... F24C 15/023 126/192
8,025,349 B2 * 9/2011 Lim ..... E05B 17/0033 16/412
8,096,040 B2 * 1/2012 Wing ..... F25D 23/028 16/412
8,328,301 B2 * 12/2012 Lee ..... A47B 95/02 312/402
8,506,028 B2 * 8/2013 Lim ..... E05B 17/0033 16/412
9,046,296 B2 * 6/2015 Wing ..... F25D 23/028
9,506,685 B2 * 11/2016 Park ..... F25D 23/00
9,777,523 B2 * 10/2017 Choi ..... E05D 15/04
9,897,368 B2 * 2/2018 Lee ..... E05F 11/10
10,145,163 B2 * 12/2018 Choi ..... E05F 11/54
10,161,669 B2 * 12/2018 Naik ..... F25D 23/028
2003/0102784 A1 * 6/2003 Friar ..... A61G 12/001 312/218
2005/0023945 A1 * 2/2005 Bartmann ..... F24C 15/026 312/319.2
2005/0023946 A1 * 2/2005 Bartmann ..... F24C 15/023 312/328
2005/0134158 A1 * 6/2005 Bartmann ..... F24C 15/023 312/319.2
2009/0205357 A1 * 8/2009 Lim ..... E05B 17/0033 62/441
2011/0050066 A1 * 3/2011 Lee ..... A47B 95/02 312/404
2011/0132024 A1 * 6/2011 Lim ..... E05B 17/0033 62/449
2011/0215691 A1 * 9/2011 Keskin ..... A47L 15/4261 312/319.2
2011/0297686 A1 * 12/2011 Lim ..... E05B 17/0033 220/592.09
2012/0280608 A1 * 11/2012 Park ..... E05B 1/0015 312/405
2013/0270990 A1 * 10/2013 Park ..... F25D 23/028 312/404
2014/0035453 A1 * 2/2014 Kwon ..... A47B 95/02 312/325
2015/0167347 A1 * 6/2015 Park ..... E05B 85/16 16/412
2015/0292793 A1 * 10/2015 Bischoff ..... F25D 23/028 312/404
2016/0076289 A1 * 3/2016 Choi ..... E05D 15/04 312/326

* cited by examiner

REFRIGERATOR AND DOOR OPENING APPARATUS FOR REFRIGERATOR

CROSS-REFERENCE TO RELATED APPLICATIONS

The present application claims priority under 35 U.S.C. 119 and 35 U.S.C. 365 to Korean Patent Application No. 10-2017-0092824, filed on Jul. 21, 2017, which is hereby incorporated by reference in its entirety.

BACKGROUND

The present invention relates to a refrigerator and a refrigerator door opening apparatus.

Generally, a refrigerator is a home appliance that can store food at low temperature in an internal storage space shielded by a door. To this end, the refrigerator is configured to keep the stored food in an optimal state by cooling the inside of the storage space using cool air generated through heat exchange with a refrigerant circulating in a refrigeration cycle.

Recently, refrigerators have become increasingly larger and multifunctional in accordance with trend of changes in dietary life and high quality of products, and refrigerators having various structures and convenience apparatuses, which may consider convenience of users and allow the efficient use of internal space, have been released.

The storage space of the refrigerators may be opened or closed by a door. The refrigerators may be classified into various types depending on the arrangement of the storage space and the structure of the door for opening and closing the storage space.

Also, the refrigerator door can be enlarged due to the increase in size of the refrigerator, and the door is often provided with a storage space. Thus, there is a problem in that it takes much effort to open the door.

Particularly, when a magnet is provided on a gasket on the rear surface of the door in order to prevent the leakage of cool air inside the door, there is a problem that may cause inconveniences in use because it takes much effort to open the door at an initial stage.

In order to solve such a problem, Korean Patent Publication No. 10-2012-0124693 discloses a refrigerator in which when a door handle is operated, an opening apparatus is operated so that the door can be opened more easily by pushing a cabinet.

However, such a conventional refrigerator has a structure in which the opening apparatus may protrude by a rotational operation distance of the handle. Therefore, in order to sufficiently secure the protruding distance for opening the door, the thickness of the opening apparatus may increases, thereby deteriorating heat insulating performance of the door. In addition, the opening apparatus is formed integrally with the door and cannot be attached to or detached from the door. Therefore, there is a problem in that the entire door needs to be separated or exchanged when an error occurs.

SUMMARY

An aspect of the present invention is directed to provide a refrigerator door opening apparatus having a slim structure.

Another aspect of the present invention is directed to provide a refrigerator door opening apparatus removably provided to a door.

Another aspect of the present invention is directed to provide a refrigerator capable of preventing deterioration of heat insulating performance even when the door opening apparatus is installed.

Another aspect of the present invention is directed to provide a refrigerator capable of maintaining the door opening apparatus and providing various options.

To achieve these and other advantages and in accordance with the purpose of the disclosure, as embodied and broadly described herein, there is provided a refrigerator including a cabinet forming a storage space; a door configured to open and close the storage space; a panel installed on a front surface of the door to form an external appearance; a door handle provided in the panel and operable to open the door; and a door opening apparatus coupled to the door handle and configured to assist in opening the door. The door opening apparatus includes a main module installed inside the panel and configured to protrude backward from the panel according to the operation of the door handle; and a sub-module provided at an end portion of the door corresponding to the main module and configured to protrude backward in conjunction with the main module to push the cabinet and open the door.

A panel opening may be formed at one side of the panel corresponding to the door handle, and an installation part, which communicates with the panel opening and in which the main module is removably installed, may be formed on a rear surface of the panel.

The main module may include a first rotator coupled to the door handle and having an upper end rotatably and axially coupled to an inside of the panel; a second rotator coupled to the first rotator to rotate in conjunction with the first rotator and axially coupled to a position lower than a rotational shaft of the first rotator to rotate a larger angle than the first rotator; and a main slider, which is in contact with an upper end of the second rotator, configured to protrude backward from the panel when the second rotator rotates.

A rotator receiving space for receiving the first rotator may be formed in the second rotator, and the first rotator may rotate in conjunction with the second rotator while received inside the second rotator.

A rotational shaft of the second rotator may be fastened through both of the first rotator and the second rotator.

A module case for receiving the first rotator, the second rotator, and the main slider may be formed in the main module, and the module case may be received inside the panel.

The sub-module may include a sub-slider provided at a side end of the door and configured to selectively protrude by the main module to push the cabinet; and a slider cover installed in the door and configured to shield the sub-slider to form an external appearance of the door.

A slider elastic-member for providing an elastic force when the sub-slider moves may be further provided in the sub-slider and the slider cover.

A slider installation part may be formed in the slider cover so that the sub-slider is drawn in or out, and the slider installation part may have an entrance and an exit with different widths.

In another aspect of the present invention, there is provided a refrigerator including a cabinet forming a storage space; a door configured to open and close the storage space; a door opening apparatus provided in the door and configured to assist in opening the door; and a door handle connected to the door opening apparatus and operable when the door is opened by a user. The door opening apparatus includes a first rotator coupled to the door handle and having an upper end rotatably and axially coupled to an inside of the door; a second rotator coupled to the first rotator to rotate in conjunction with the first rotator and axially coupled to a position lower than a rotational shaft of the first rotator to rotate a larger angle than the first rotator; and a slider, which is in contact with an upper end of the second rotator, configured to protrude backward from the door when the second rotator rotates.

A receiving space for receiving the first rotator may be formed inside the second rotator, and the first rotator may be coupled to a lower end of the second rotator inside the receiving space.

In another aspect of the present invention, there is provided a refrigerator door opening apparatus including a module case forming a recessed space; a first rotator rotatably installed inside the module case, coupled to a door handle of a refrigerator, and configured to rotate when the door handle is operated; a first shaft, which is a rotational shaft of the first rotator, passing through an upper end of the first rotator; a second rotator coupled to a lower end of the first rotator to rotate in conjunction with the first rotator by a larger angle than the first rotator and extending upward over the first rotator; a second shaft, which is a rotational shaft of the second rotator, passing through the second rotator at a position lower than the first shaft; and a slider supported by an upper end of the second rotator inside the module case and configured to push a cabinet of the refrigerator when the second rotator rotates and to assist in opening a door.

A pair of first shaft support parts, which protrude from positions spaced apart from each other and support both ends of the first shaft, may be formed on a bottom surface of the module case, and a pair of second shaft support parts, which protrude from positions spaced apart from each other and support both ends of the second shaft, may be formed behind the first shaft support parts.

A receiving space for receiving the first rotator may be formed in the second rotator, and the first rotator may be coupled to the second rotator while received inside the second rotator.

The second shaft may pass through all the second shaft support part, the second rotator, and the first rotator.

A first elongated hole, through which the second shaft is to pass and which extends horizontally, may be formed in the first rotator to limit the rotation of the first rotator, and a second elongated hole, through which the second shaft is to pass and which extends vertically, may be formed in the second rotator to limit the rotation of the second rotator.

The refrigerator door opening apparatus may further include a third shaft which passes through lower ends of the first rotator and the second rotator and to which the first rotator and the second rotator are rotatably coupled.

An elastic member for providing an elastic force when the first rotator rotates may be provided in the first shaft.

The receiving space may include an upper receiving part which is opened so that the first shaft is received through the first shaft support part and the first rotator and a lower receiving part which extends downward from a center of the upper receiving part and receives the first rotator.

The lower receiving part may be placed in a gap of the second shaft support part, and the second shaft may sequentially pass through the second shaft, the lower receiving part, and the first rotator.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Hereinafter, specific embodiments of the present invention will be described in detail with reference to the accompanying drawings. However, the present invention is not limited to the embodiment in which the spirit of the present invention is presented, and other retrogressive inventions or other embodiments falling within the spirit of the present invention may be easily proposed by addition, modification, or removal of components.

Figure 1:
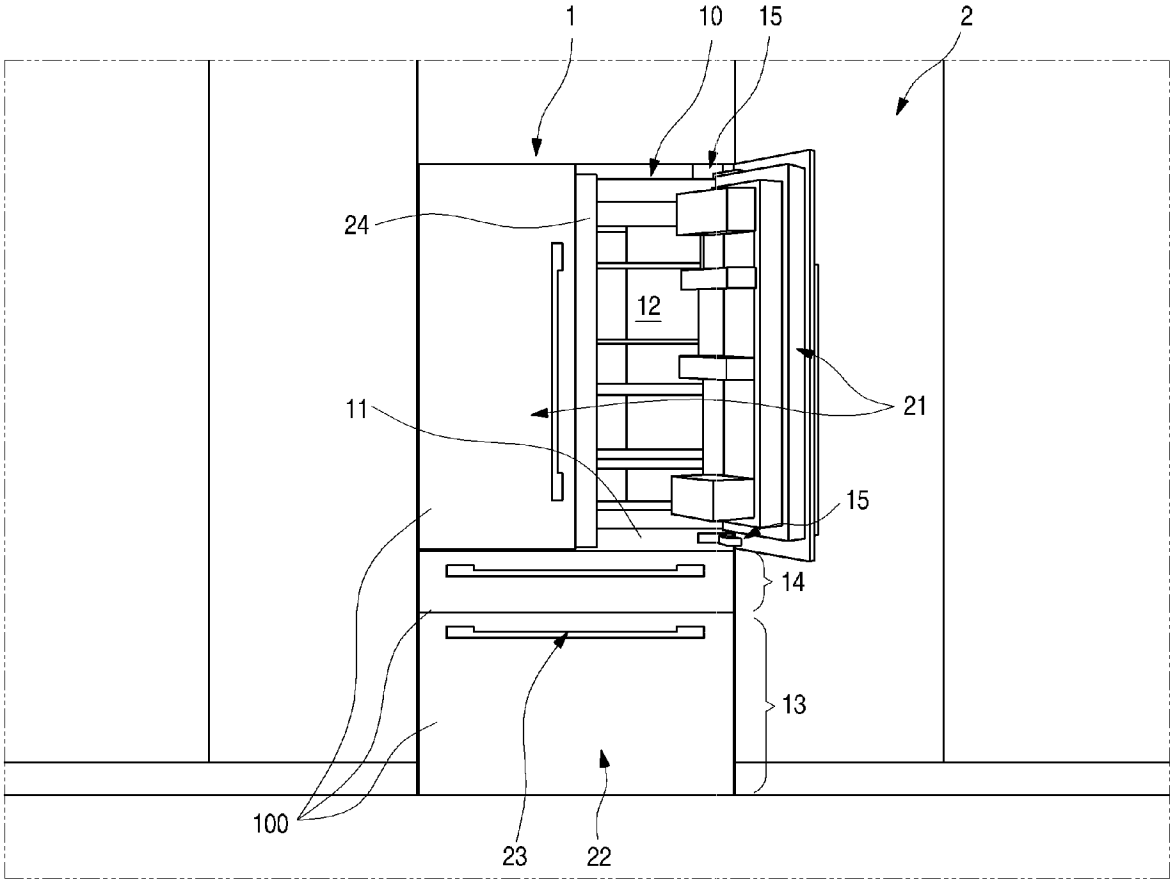
FIG. 1 is a diagram showing an installation state of a refrigerator according to an embodiment of the present invention.
Figure 2:
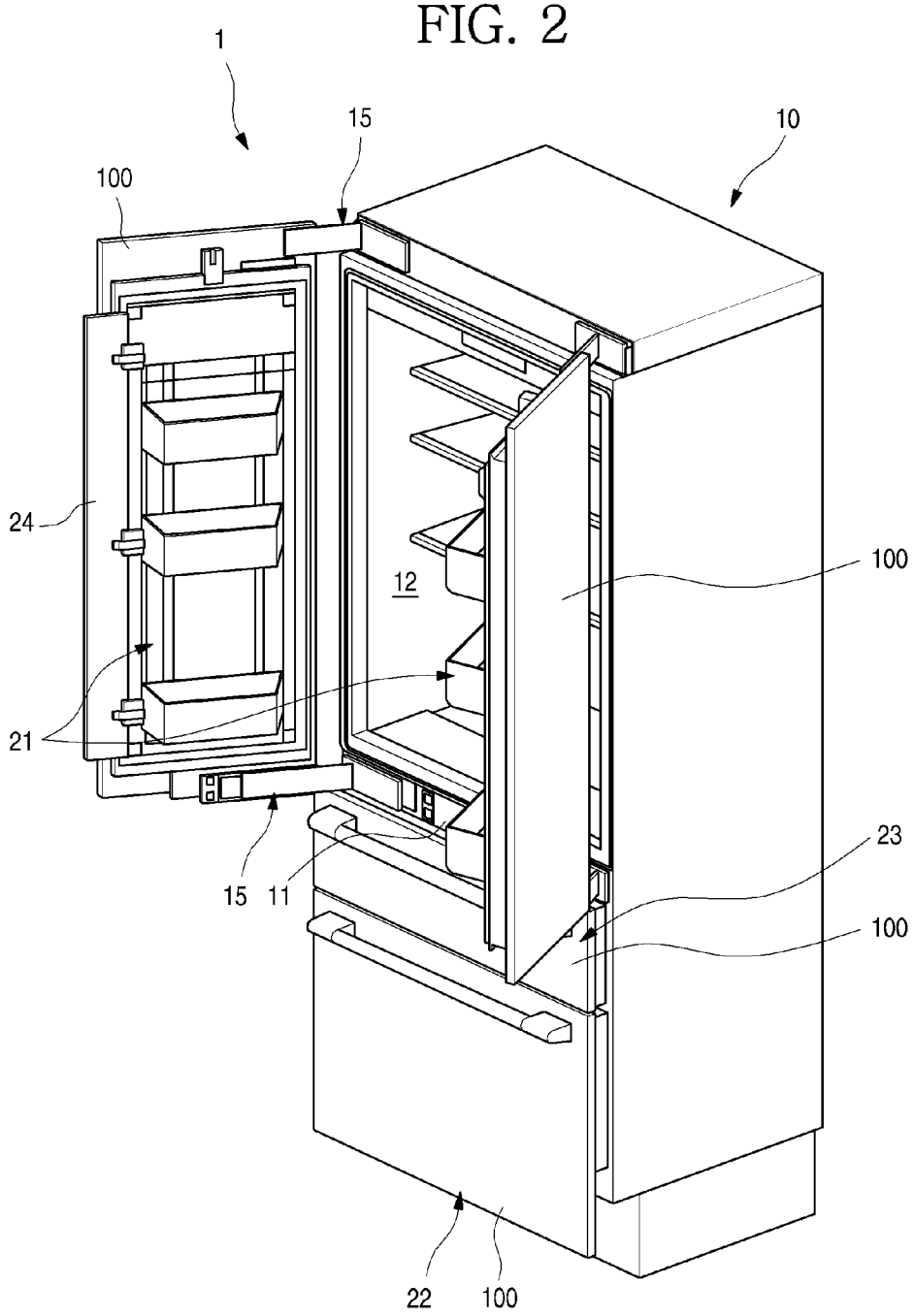
FIG. 2 is a perspective view of the refrigerator with some doors being open.

FIG. 1 is a diagram showing an installation state of a refrigerator according to an embodiment of the present invention. Also, FIG. 2 is a perspective view of the refrigerator with some doors being open.

According to an embodiment of the present invention, a refrigerator 1 may be a built-in refrigerator that may be installed, in an integrated manner, in furniture 2 disposed indoor or between walls on which an exterior is formed.

As shown in FIG. 1, the refrigerator 1 may be installed in an integrated manner with nearby furniture 2, and may have a front exterior formed by a panel 100 having the same material or texture as the furniture. The panel 100 may be placed coplanar with the front surface of the furniture 2 near the refrigerator 1 while the refrigerator 1 is installed.

The refrigerator 1 may have an external appearance formed by a cabinet 10 for entirely forming a storage space and a door 22 for shielding an opened front surface of the cabinet 10. The door 22 may be equipped with the panel 100, or the door 22 and the panel 100 may be defined as separate components.

The storage space may be divided into multiple spaces inside the cabinet 10. For example, as shown in FIGS. 1 and 2, the storage space may be composed of a refrigerating chamber 12 in an upper portion, a freezing chamber 13 in a lower portion, and a switching chamber 14 provided between the refrigerating chamber 12 and the freezing chamber 13. The refrigerating chamber 12 may be maintained at a temperature of the refrigerating area, and the freezing chamber 13 may be maintained at a freezing temperature to freeze and then store food. Also, the switching chamber 14 may be switched into the refrigerating chamber 12 or the freezing chamber 13 depending on selective flow of cool air and then used. The switching chamber 14 may be configured to be maintained at a predetermined temperature as necessary.

It will be appreciated that the configuration of the storage space is not limited to this embodiment and the storage space may be variously configured depending on the form of the refrigerator 1.

The door may include a refrigerating chamber door 21, a freezing chamber door 22, and a switching chamber door 23, which may individually open or close the storage space. The door may be variously placed corresponding to the configuration of the door or the configuration of the storage space.

For example, the refrigerating chamber door 21 may be composed of a pair of doors to shield the refrigerating chamber 12. The refrigerating chamber door 21 may be provided at both left and right sides as a pair of doors and may be rotatably connected to the cabinet 10 by a hinge device 15 and configured to open or close the refrigerating chamber 12.

The refrigerating chamber doors 21 may be provided such that both of the left and right sides thereof are rotatable. Accordingly, the single refrigerating chamber 12 may partially or entirely open or close the refrigerating chamber 12 by using the refrigerating chamber doors 21. The hinge device 15 may be provided at an upper end and a lower end of the refrigerating chamber door 21 so that the refrigerating chamber door 21 can rotate. Since the refrigerator 1 is a built-in refrigerator installed in the form of furniture 2, the hinge device 15 may prevent the panel 100 from being obstructed by the nearby furniture 2 when the refrigerating chamber door 21 is opened or closed.

A shielding device 24 may be provided between the refrigerating chamber doors 21 and may prevent leakage of cool air inside the refrigerating chamber 12 by shielding a gap between the refrigerating chamber doors 21 while the refrigerating chamber doors 21 are closed.

The freezing chamber door 22 and the switching chamber door 23 may be opened or closed by sliding into or out of the freezing chamber 13 and the switching chamber 14. Also, the freezing chamber door 22 and the switching chamber door 23 may be configured to have the same structure as a drawer, and the freezing chamber door 22 may be directly or indirectly coupled to a device such as a rail 530 provided inside the cabinet 10 and may be drawn in or out along with the drawer.

The panel 100 may be installed in the front surfaces of the refrigerating chamber door 21, the freezing chamber door 22, and the switching chamber door 23. When the refrigerator 1 is installed, an external appearance may be formed by the panel 100. Also, while the panel 100 is attached to the front surfaces of the refrigerating chamber door 21, the freezing chamber door 22, and the switching chamber door 23, gaps between the doors are very small. As a result, the refrigerator 1 may look like a piece of the furniture 2 when viewed from the outside. Also, a handle is provided on the panel 100 so that the refrigerating chamber 12, the freezing chamber 13, and the switching chamber 14 may be opened or closed by pulling the door handle 110 to rotate the refrigerating chamber door 21 or to draw in or out the freezing chamber door 22 or the switching chamber door 23.

The embodiment of the present invention may be applied regardless of the types and forms of the refrigerator and the door. However, for convenience of explanation and understanding, the embodiment will be described as being applied to the freezing chamber door 22, which may be drawn in or out like a drawer, and the freezing chamber door 22 will be referred to as a door.

Figure 3:
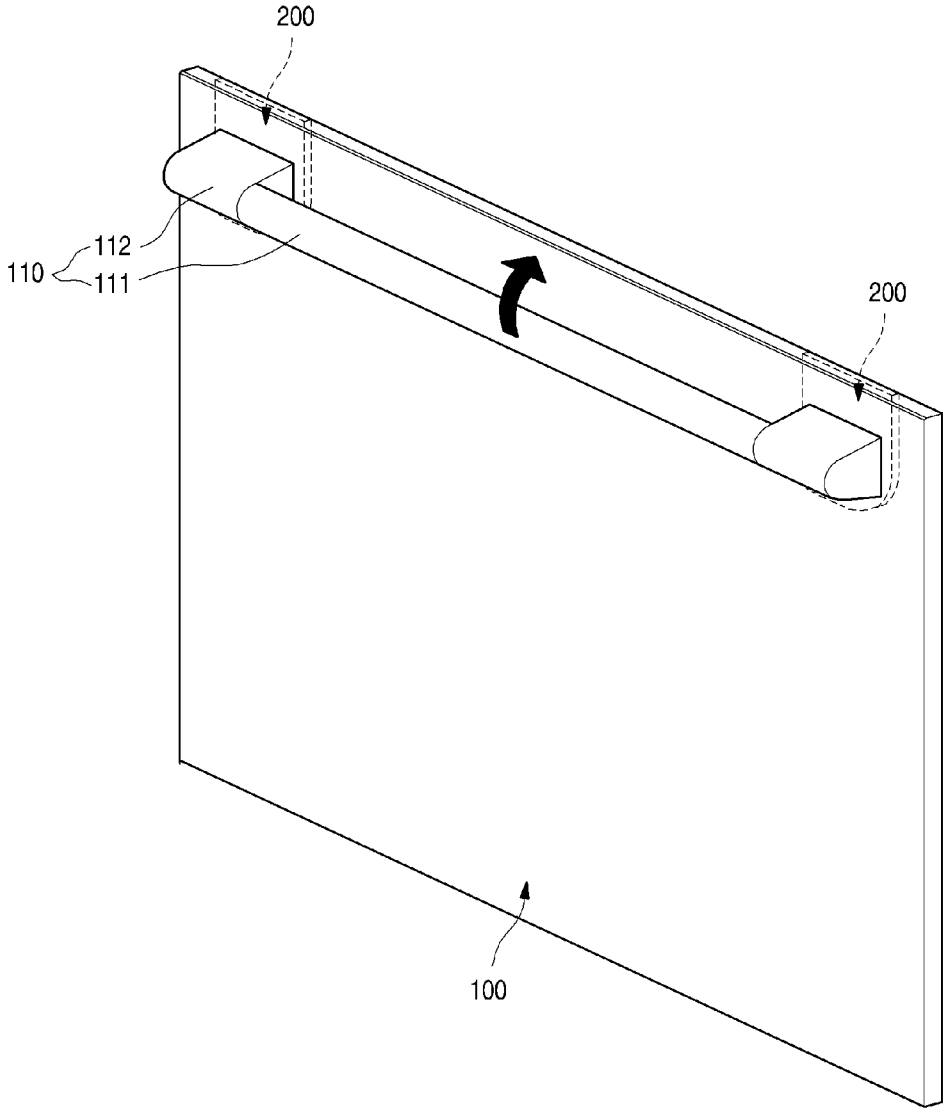
FIG. 3 is a perspective view of a panel of the refrigerator.
Figure 4:
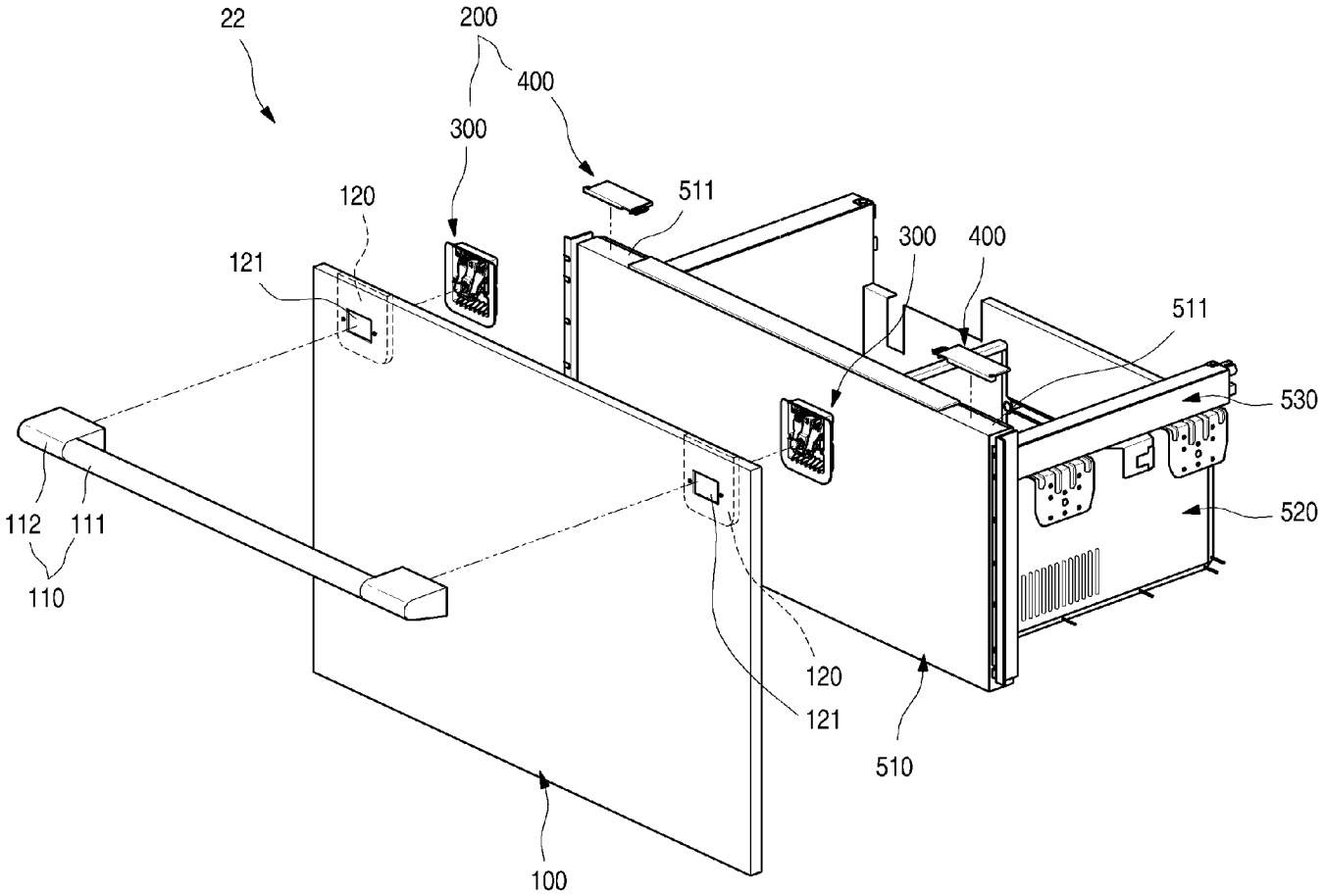
FIG. 4 is an exploded perspective view showing a coupling structure of the panel and the door of the refrigerator.

FIG. 3 is a perspective view of the panel of the refrigerator. FIG. 4 is an exploded perspective view showing a coupling structure of the panel and the door of the refrigerator.

As shown in the drawings, the panel 100 may be formed in a plate shape larger than or corresponding to the size of the door 22. The panel 100 may be formed of the same material, and to the same thickness, as those of the neighboring furniture 2 and may have substantially the same appearance and texture as the furniture 2.

The panel 100 may be formed of various materials, such as metal, plastic, and wood, and of a combination of at least one or more of the materials. Also, the panel 100 may be surface-treated to have unique texture and color, and an external appearance of the panel 100 may be formed in various ways such as file coating, painting, printing, and the like.

The door handle 110 may be provided on the front surface of the panel 100. The door handle 110 may be disposed at an upper end of the panel 100 or a position adjacent to the upper end to facilitate draw-in and draw-out of the door 22. The door handle 110 may include a handle bar 111 formed in a bar shape and capable of being grasped by a user and a handle supporter 112 provided at both sides of the handle bar 111 and configured to separate the handle bar 111 from the front surface of the panel 100. The handle bar 111 may extend horizontally and may extend vertically depending on the shape of the door 22.

The door opening apparatus 200 may be provided in the panel 100. When the door handle 110 is rotated, an element of the door opening apparatus 200 may selectively protrude backward to push the cabinet, thus facilitating opening of the door 22.

The door opening apparatus 200 may be provided at positions corresponding to a pair of handle supporters 112, and a pair of door opening apparatuses 200 may be respectively coupled to the handle supporters 112.

An opening apparatus installation part 120, which is recessed so that the door opening apparatus 200 is installed, may be formed on the rear surface of the panel 100. The door opening apparatus 200 may be inserted into the opening apparatus installation part 120, and is fixed inside the panel, but is not exposed to the outside. Also, the door opening apparatus 200 may be easily attachable to, or detachable from, the opening apparatus installation part 120 placed on the rear surface of the panel 100. Accordingly, when the door opening apparatus 200 needs to be repaired, the door opening apparatus 200 may be separated through the rear surface of the panel 100.

The door opening apparatus 200 includes a main module 300, and the main module 300 is provided inside the panel 100. A portion of the main module 300 may be exposed to the outside through a panel opening 121 formed at both sides of the panel 100. Also, a portion of the main module 300 exposed through the panel opening 121 may be coupled to the handle supporter 112.

While coupled to the door opening apparatus 200, the door handle 110 may be configured to, when viewed in FIG. 3, rotate a predetermined angle clockwise with respect to the front surface of the door 22.

The panel 100 may be coupled to the front surface of a door case 510 forming the front surface of the door 22. The door case 510 may shield an opened front surface of the storage space to form the external appearance of the door 22.

That is, for the built-in refrigerator 1, the storage space may be opened or closed by the door case 510, and the panel 100 may be appropriately installed on the front surface of the door case 510 according to furniture or walls near where the refrigerator 1 is installed. Accordingly, while the panel 100 is installed in the door case 510, the panel 100 forms the external appearance of the front surface of the refrigerator 1. For such a reason, the panel may be included in the door.

The door case 510 may be formed of a metal or plastic material. If necessary, metal and plastic may be partially provided together. Further, a heat insulating material may be provided inside the door case 510 so that the storage space may be insulated against heat. Also, a gasket (not shown) in close contact with the front end of the cabinet 10 may be further provided on the rear surface of the door case 510, and the storage space is further sealed by the gasket to prevent leakage of cool air.

The receiving member 520 may be installed on the rear surface of the door case 510. The receiving member 520, which forms a space for receiving food, may be opened upward. When the door is opened or closed, the receiving member 520 may be drawn in or out along with the door case 510. Accordingly, the door may be referred to as a drawer type door.

A rail 530 may be provided at both sides of the receiving member 520. The rail 530 may be configured to extend in multiple stages, and may be fixed at both ends inside the storage space and the receiving member 520. Accordingly, the door 22 may be drawn in or output by extension of the rail 530, and the receiving member 520 may be drawn out to the outside.

A sub-module 400, which is included in the door opening apparatus 200, may be provided on the upper surface of the door case 510. The sub-module 400 and the main module 300 may be disposed on the same extension line. The sub-module 400 may be operable in conjunction with the main module 300 and may substantially function to push the door 22 from the cabinet 10 to open the door 22.

In order to install the sub-module 400, a sub-module installation part 511 may be formed at both sides of the upper surface of the door case 510. While the sub-module 400 is installed in the sub-module installation part 511, the upper surface of the door case 510 may be formed to have the same height and size as the upper surface of the sub-module 400. The sub-module 400 may be provided detachably from the sub-module installation part 511 and may be selectively installed along with the main module 300.

The door opening apparatus 200 may include the main module installed in the panel 100 and the sub-module 400 installed in the door case 510. A specific structure of the door opening apparatus 200 will be described in detail below with reference to the drawings.

Figure 5:
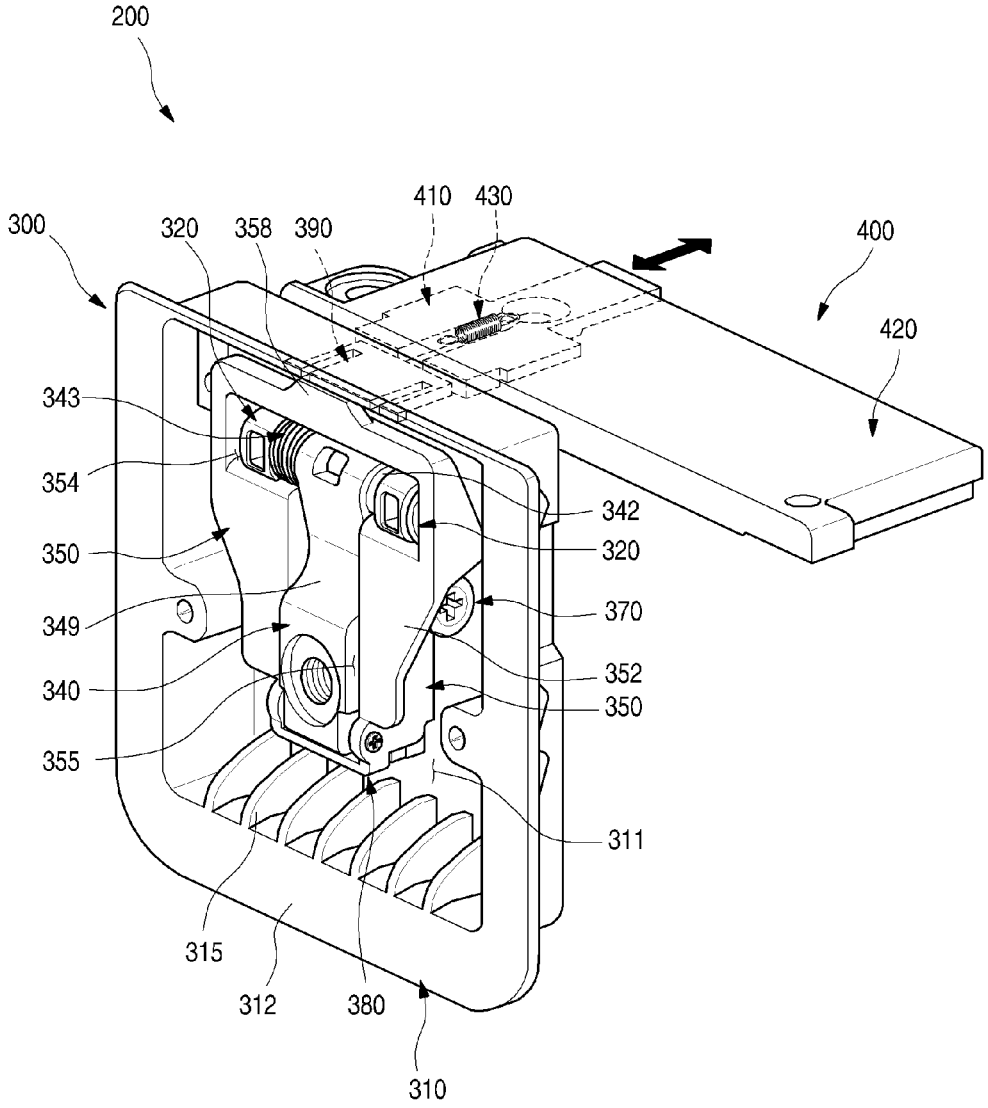
FIG. 5 is a perspective view of a door opening apparatus according to an embodiment of the present invention.
Figure 6:
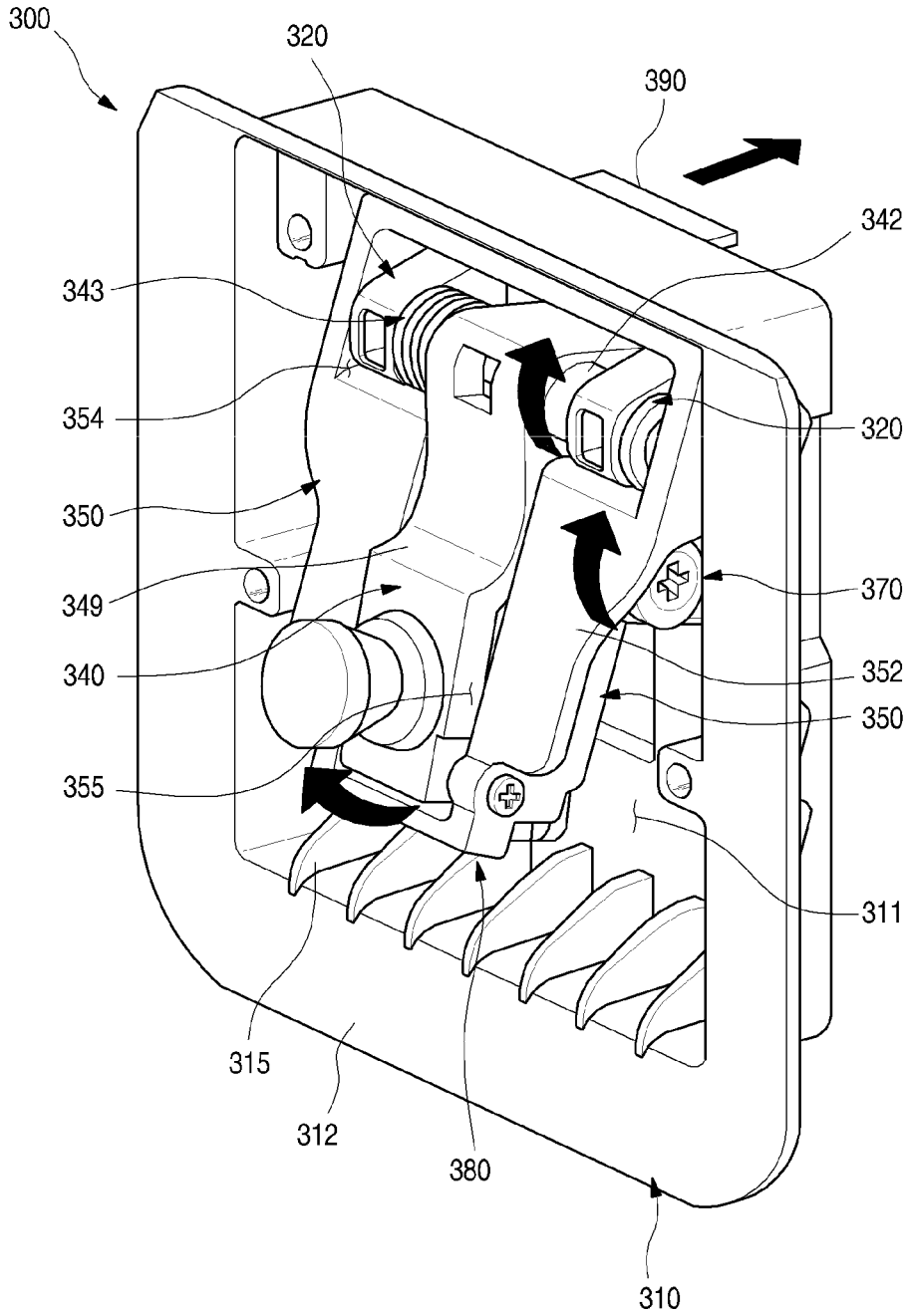
FIG. 6 is a perspective view of a main module of the door opening apparatus.
Figure 7:
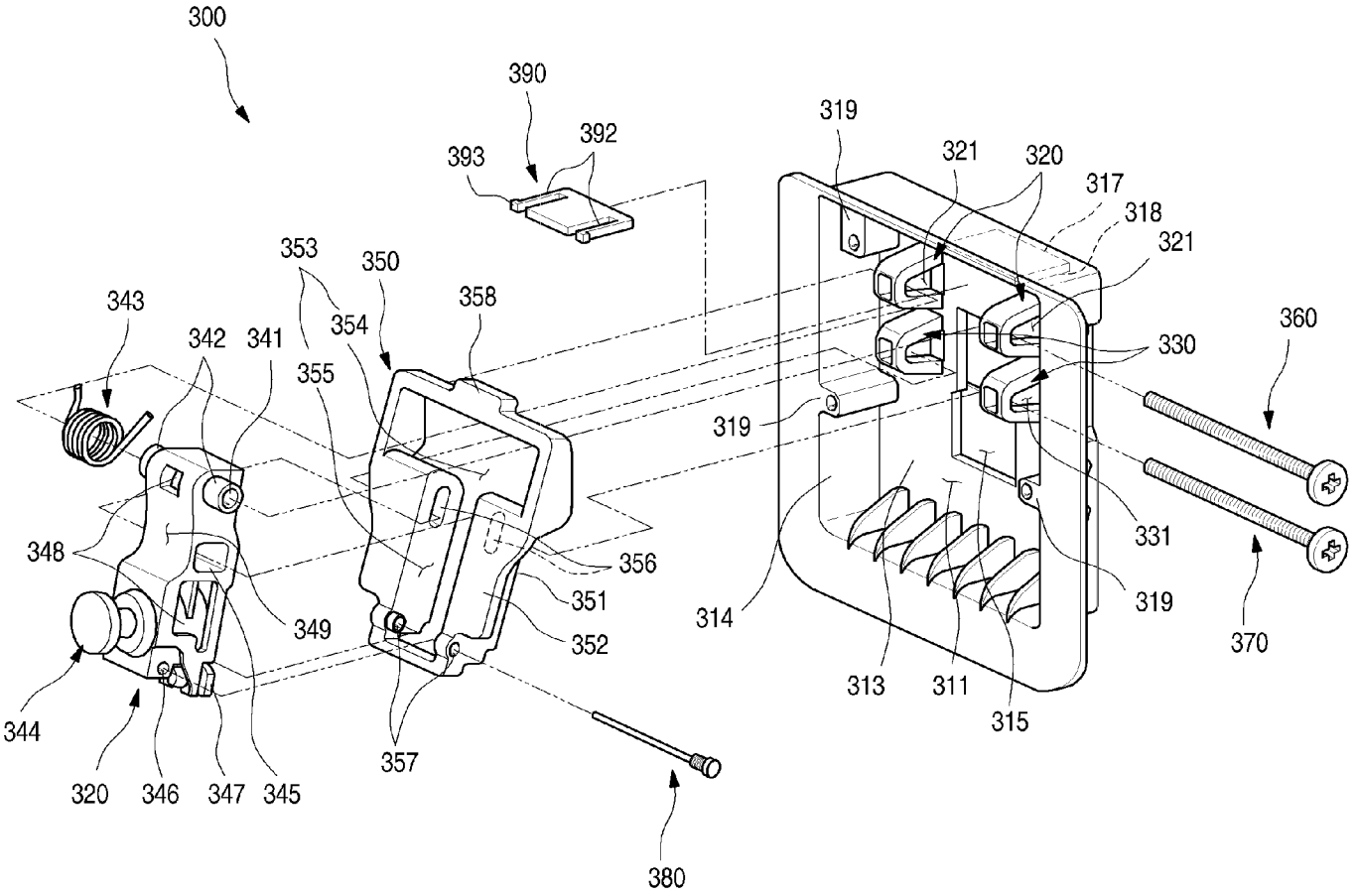
FIG. 7 is an exploded perspective view of the main module.

FIG. 5 is a perspective view of the door opening apparatus according to an embodiment of the present invention. Also, FIG. 6 is a perspective view of the main module of the door opening apparatus. Also, FIG. 7 is an exploded perspective view of the main module.

As shown in the drawings, the door opening apparatus 200 may include the main module 300. The main module 300 may be installed in the opening apparatus installation part 120 of the panel 100 and may have a structure capable of coupling to the door handle 110.

Generally, the main module 300 may include a module case 310 configured to form an external appearance, a first rotator 340 rotatably installed in the module case 310, and a second rotator 350 configured to rotate along with the first rotator 340.

In detail, the module case 310 may be formed in a shape corresponding to the opening apparatus installation part 120 so that the module case 310 can be installed in the opening apparatus installation part 120 and may form a receiving space 311 in which the first rotator 340 and the second rotator 350 can be rotatably installed.

The front surface of the receiving space 311 is formed in a rectangular shape, and an opened front surface of the receiving space 311 may be shielded by the front surface of the panel 100. Also, a rim 312 may be formed around the module case 310. The rim 312, which is a part in close contact with the panel 100, may be attached to the panel 100 by an adhesive member such as an adhesive or a double-sided tape.

The module case 310 may be in communication with the panel opening 121 while being installed in the panel 100, and may be coupled to the handle supporter 112 through the panel opening 121.

A plurality of reinforcing ribs 315 for supporting a bottom surface 313 of the module case 310 and a circumferential surface 314 of the module case 310 may be provided on the inner bottom of the receiving space 311. The reinforcing ribs 315 may stably support the door handle 110 without damaging the module case 310 even when the door handle 110 is repeatedly rotated.

A case opening 316 may be form at the center of the bottom surface of the receiving space 311. The case opening 316 may be formed at a position corresponding to the first rotator 340, and while the first rotator 340 is perfectly received inside the receiving space, the case opening 316 may prevent the first rotator 340 from being obstructed by the bottom surface 313 of the module case 310.

A slider slot 317 may be formed above the case opening 316. The slider slot 317, which is an opening through which a main slider 390 to be described below passes, is positioned at an upper end of the bottom surface 313 of the module case 310. The slider slot 317 may be formed in a size corresponding to one side of the main slider 390 so that the main slider 390 can pass through the slider slot 317. A slider guidance part 318 for guiding movement of the main slider 390 may be further formed on an inner upper surface of the case opening 316. The slider guidance part 318 may be formed at both sides of the slider slot 317 and in contact with the circumference of the main slider 390.

A plurality of fastening parts 319 may be formed on the opened front surface of the case opening 316. The fastening part 319 may be connected to the circumferential surface 314 of the module case 310. In the fastening part 319, a hole to which a screw is to be fastened may be formed. Accordingly, while the module case 310 is placed in close contact with the panel 100, a screen fastening to the panel 100 may be fastened to the hole so that the module case 310 can be firmly coupled to an inner surface side of the panel 100.

Also, a first shaft support part 320 and a second shaft support part 330 may be vertically disposed at both sides of the case opening 316. A pair of first shaft support parts 320 and a pair of second shaft support parts 330 may be provided so that the first rotator 340 and the second rotator 350 may be rotatably installed, respectively.

A pair of first shaft support parts 320 and a pair of second shaft support parts 330 may be provided to support both ends of a first shaft 360, which is a rotational shaft of the first rotator 340, and both ends of a second shaft 370, which is a rotational shaft of the second rotator 350, so that the first rotator 340 and the second rotator 350 may be rotatably installed, respectively.

The first shaft support part 320 may be placed on the module case 310 and may be located on both left and right sides of the first rotator 340. In detail, the first shaft support part 320 may be formed at a location adjacent to the slider slot 317 and may protrude toward the opened front surface from the bottom surface 313 of the module case 310. A first through-hole 321, through which the first shaft 360 is to pass, may be formed on the first shaft support part 320. Also, the first shaft support part 320 may be configured to support the first shaft 360 passing through the first rotator 340 at both sides.

The second shaft support part 330 may be located behind the first shaft support part 320. The second shaft support part 330 may have the same shape as the first shaft support part 320. Also, a second through-hole 331, through which the second shaft 370 is to pass, may be formed on the second shaft support part 330. The second shaft support part 330 may be configured to support the second shaft 370 passing through the second rotator 350 at both sides.

The first rotator 340 and the second rotator 350 may be installed in the first shaft support part 320 and the second shaft support part 330, respectively. The first rotator 340 and the second rotator 350 may be placed inside the receiving space 311 of the module case 310 while coupled to each other. Also, the first rotator 340 may be placed between the pair of first shaft support parts 320, and the second rotator 350 may be placed outside the second shaft support part 330.

The first rotator 340 may be formed to be vertically long and coupled to the door handle 110.

In detail, a first rotator hole 341, through which the first shaft 360 is to pass, may be formed at an upper end of the first rotator 340. The first rotator hole 341 may be the center of rotation of the first rotator 340, and the first rotator 340 may rotate about the first shaft 360 that passes through the first rotator hole 341.

A shaft boss 342 protruding from upper ends at both sides of the first rotator 340 in both side directions may be formed in the first rotator hole 341. The first rotator hole 341 may be formed through the shaft boss 342, and the first shaft 360 may be fastened through the shaft boss 342 and then rotatably installed in the first shaft support part 320.

An elastic member 343 may be provided in at least one of the sides of the shaft boss 342. The elastic member 343 may be formed in the shape of a torsion spring that provides an elastic force when the first rotator 340 rotates, and both ends of the elastic member 343 are engaged to the first rotator 340 and one side of the module case 310 to provide an elastic force for returning to an initial position when the first rotator 340 rotates.

That is, when the user operates the door handle 110 to enable the first shaft 360 to rotate the first rotator 340 clockwise, the elastic force of the elastic member 343 is generated. When the door handle 110 is released after the operation of the user, the first rotator 340 rotates counterclockwise about the first shaft 360 and returns to its original position before the rotation due to the elastic force of the elastic member 343.

A handle coupling part 344 may be formed at a front lower end of the first rotator 340. The handle coupling part 344 may protrude forward and may protrude outward through the panel opening 121. The handle coupling part 344 may be formed as a separate member and then installed in the first rotator 340. Also, a coupling receiving part 113 to be coupled to the handle coupling part 344 may be formed in the handle supporter 112, and the handle coupling part 344 may be inserted into the coupling receiving part 113. The handle coupling part 344 may be engaged by the fastening member 114 fastened from the outside while the handle coupling part 344 is inserted into the coupling receiving part 113 and may maintain a state in which the first rotator 340 and the door handle 110 are coupled to each other. Accordingly, when the user rotates the door handle 110, the first rotator 340 may also rotate.

Also, a first elongated hole 345, through which the second shaft 370 is to pass, may be formed on both sides of the first rotator 340 at a height corresponding to the second shaft support part 330. The first elongated hole 345 may be formed to have a diameter larger than that of the second shaft 370. The first elongated hole 345 may be elongated front and back so that the first rotator 340 is not obstructed by the first elongated hole 345 even when the first rotator 340 rotates.

A rotator coupling hole 346 may be formed at bottom ends of both sides of the first rotator 340. A third shaft 380, which is to be fastened through the second rotator 350, may be fastened to the rotator coupling hole 346. Accordingly, the first rotator 340 and the second rotator 350 may be coupled to each other by the third shaft 380 and may rotate about the third shaft 380 with respect to each other.

That is, when the first rotator 340 rotates about the first shaft 360 by the user operating the door handle 110, the second rotator 350 may also rotate since the second rotator 350 is coupled to the first rotator by the third shaft 380. In this case, the second rotator 350 may rotate about the second shaft 370.

A stopping member 347 may be provided at a rear lower end of the first rotator 340. The stopping member 347 may be formed of an elastic material such as rubber or silicone. When the first rotator 340 rotates counterclockwise and returns to an initial position, the stopping member 347 comes into contact with a bottom surface of the module case 310 to stop the first rotator 340 and alleviate shock at this time.

At least one or more slit holes 348 may be formed at both sides and a front upper portion of the first rotator 340. By using the slit holes 348, the first rotator 340 may be formed in an accurate shape without being deformed during injection molding.

Also, a recessed surface 349 may be formed on the front surface of the first rotator 340. The recessed surface 349 forms a recessed space so that the first rotator 340 is not obstructed by an end portion of the panel opening 121 when the first rotator 340 rotates.

The second rotator 350 may be received inside the module case 310 and configured to rotate about the second shaft 370. Also, the first rotator 340 may be received inside the second rotator 350, and the second rotator 350 may rotate along with the first rotator 340.

The second rotator 350 may include a rotator body 351 configured to form a rotator receiving space for receiving the first rotator 340 and a front surface part 352 configured to form a front surface of the rotator body 351 in which at least a portion of the circumference of the rotator body 351 is bent outward. An opening is at the center of the rotator body 351, and the rotator receiving space 353 may be formed inside the opening.

The rotator receiving space 353 may include an upper receiving part 354 placed at an upper portion of the second rotator 350 and a lower receiving part 355 extending downward from the upper receiving part 354. The upper receiving part 354 may be formed laterally, and an upper portion of the first shaft support part 320, an upper portion of the first rotator 340, and the first shaft passing through the first shaft support part 320 and the first rotator 340 may be received inside the upper receiving part 354. That is, when viewed from the front side, the first shaft 360, the first shaft support part 320, and the elastic member 343 as well as the upper portion of the first rotator 340 may be exposed through the upper receiving part 354.

The lower receiving part 355 may extend downward from the center of the upper receiving part 354 and may be formed in a shape corresponding to the first rotator 340. That is, the lower receiving part 355 may have a width formed corresponding to a lateral thickness of the first rotator 340 and also have a vertical length extending up to a position corresponding to a lower end of the first rotator 340. Therefore, the first rotator 340 may be completely received inside the rotator receiving space 353, and the first rotator 340 may be exposed through the opened front surface of the rotator receiving space 353.

The lower receiving part 355 may be placed between the pair of second shaft support parts 330. That is, the lower receiving part 355 may be placed inside the second shaft support part 330 and also may be formed such that the first rotator 340 can be completely received.

A second elongated hole 356, through which the second shaft 370 is to pass, may be formed at both sides of the lower receiving part 355. In this case, the second elongated hole 356 may be formed at a position corresponding to the second shaft support part 330 and the first elongated hole 345. Accordingly, the second shaft 370 may be fastened to the second shaft support part 330 through the first elongated hole 345 and the second elongated hole 356 as well as the second shaft support part 330.

That is, the second shaft 370 may be the center of rotation of the second rotator 350 and may be configured to selectively push and move the main slider 390 by the rotation of the second rotator 350. The second elongated hole 356 may extend vertically, and the second shaft 370 may vertically move inside the second elongated hole 356 by the rotation of the second rotator 350.

The second shaft support part 330 may be placed at both sides of the second elongated hole 356 and may be placed more outward than both the sides of the rotator body 351. Accordingly, the second rotator 350 may be placed inside the second shaft support part 330, and the first rotator 340 may be disposed inside the second rotator 350. That is, with respect to the both sides of the rotator body 351 in which the second elongated hole 356 is formed, the shaft support part 330 may be placed at an outer side, and the first rotator 340 may be placed at an inner side. Also, the second shaft 370 is configured to sequentially pass through the second shaft support part 330 placed at an outmost region, the second elongated hole 356, and the first elongated hole 345.

A rotator front-surface part 352 may be formed in at least a portion of the circumference of the second rotator 350. The rotator front-surface part 352 may be bent outward at a position corresponding to the opened front end of the lower receiving part 355.

Also, the rotator front-surface part 352 may be bent outward at a lower end of the upper receiving part 354. Accordingly, the rotator front-surface part 352 may be formed in a planar shape that connects a side end of the lower receiving part 355 and a lower end of the upper receiving part 354. Also, while the first rotator 340 and the second rotator 350 are installed in the module case 310, both ends of the second shaft 370 and the second shaft support part 330 may be shielded by the rotator front-surface part 352 when viewed from the front side.

The rotator front-surface part 352 may connect the upper receiving part 354 and the lower and also may be formed vertically to the rotator body 351 to enhance the entire intensity of the second rotator 350. In particular, the rotator front-surface part 352 prevents structural deformation and damage so that a force generated during the rotation of the second rotator 350 may be fully transferred to the main slider 390.

A body hole 357 to which the third shaft 380 is fastened may be formed at lower ends of both sides of the rotator body 351. The body hole 357 may be formed at a front end of the second rotator 350 and may be formed in front of a center line of the rotator 340. Also, the third shaft 380 passes through the body hole 357 and the rotator coupling hole 346 so that the first rotator 340 and the second rotator 350 may be axially coupled to each other. Accordingly, the first rotator 340 and the second rotator 350 may have a rotatable structure.

A push part 358 for moving the main slider 390 may be formed at an upper end of the rotator body 351. The push part 358 may protrude upward from the center of the upper end of the rotator body 351 and may extend to come into contact with the rear end of the main slider 390. Also, the push part 358 may be formed corresponding to or smaller than the width of the main slider 390.

The push part 358 may be configured to push the main slider 390 backward to move the main slider forward when the rotator body 351, that is, the second rotator 350 rotates. Also, the main slider 390 may be configured to push and move the sub-slider 410 forward while being in contact with the sub-slider 410.

The main slider 390 may be received inside the slider guidance part 318 and formed in a planar shape that may pass through the slider slot 317. While the second rotator 350 does not rotate, the main slider 390 has a front end placed at an opening side of the slider slot 317 and a rear end placed in contact with the push part 358. Accordingly, when the first rotator 340 and the second rotator 350 rotate clockwise due to operation of the door handle 110, the push part 358 may push the main slider 390 so that the main slider 390 can protrude outward through the slider slot 317. In this case, the protrusion distance of the main slider 390 may be formed such that the sub-slider 410 can be pushed to separate the door 22 from the cabinet 10. To this end, the sub-slider 410 may be provided at an upper end of the door 22 and slid on the same extension line as the main slider 390 so that the door 22 can be easily opened from the cabinet 10.

The main slider 390 may include a contact part 391 being in contact with the push part 358, a cutting part 392 being cut at both sides of the contact part 391, and a hook 393 protruding from the rear end of the main slider 390 in both left and right directions. Both ends of the main slider 390 may be elastically deformed by the cutting part 392. Accordingly, the main slider 390 may be inserted through the slider slot 317 formed in the module case 310. In this case, while elastically deformed by the cutting part 392, both ends of the main slider 390 may be easily inserted into the slider slot 317.

The door opening apparatus 200 may include the sub-module 400 provided in the door 22 and interoperating with the main module 300. Also, the sub-module 400 may include the sub-slider 410 and a slider cover 420.

Figure 8:
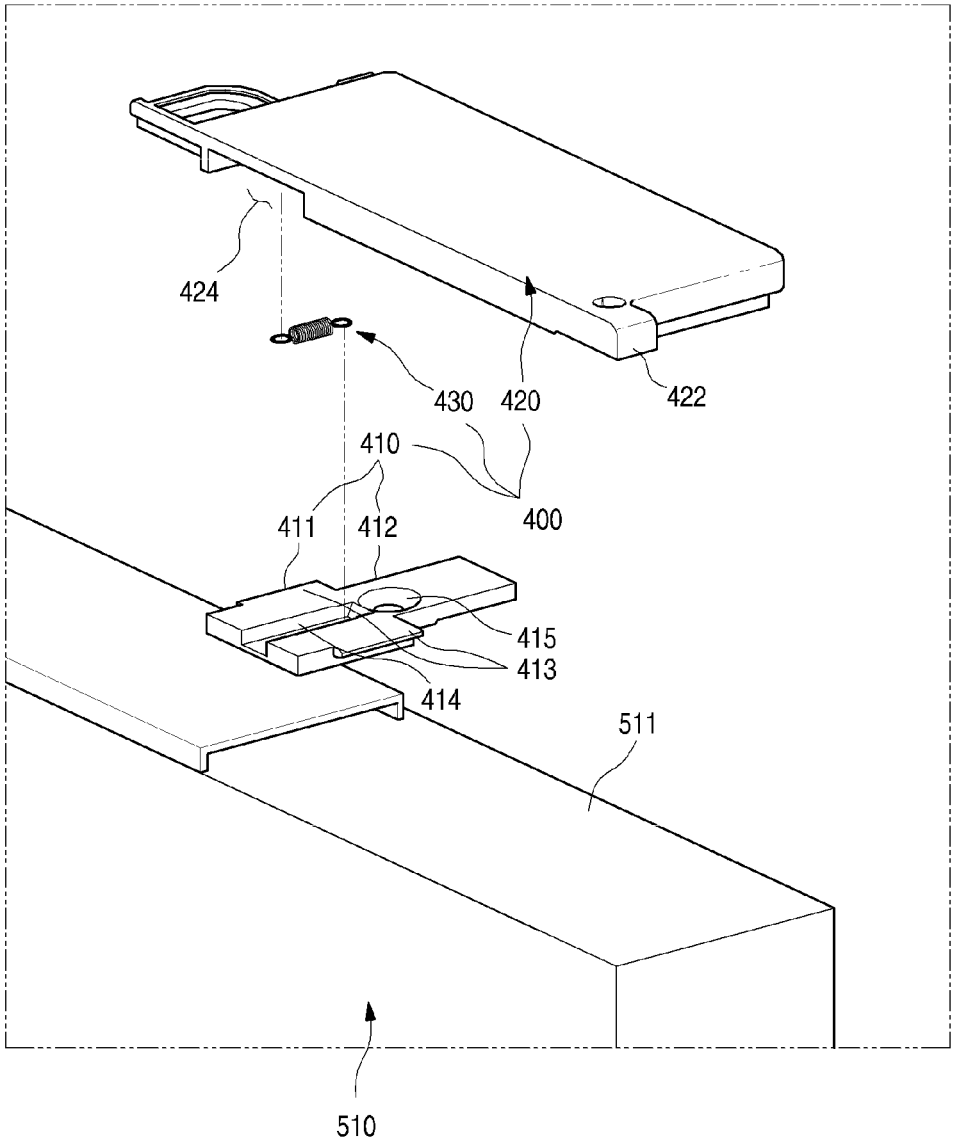
FIG. 8 is an exploded perspective view showing a coupling structure of the door and a sub-module of the door opening apparatus.
Figure 9:
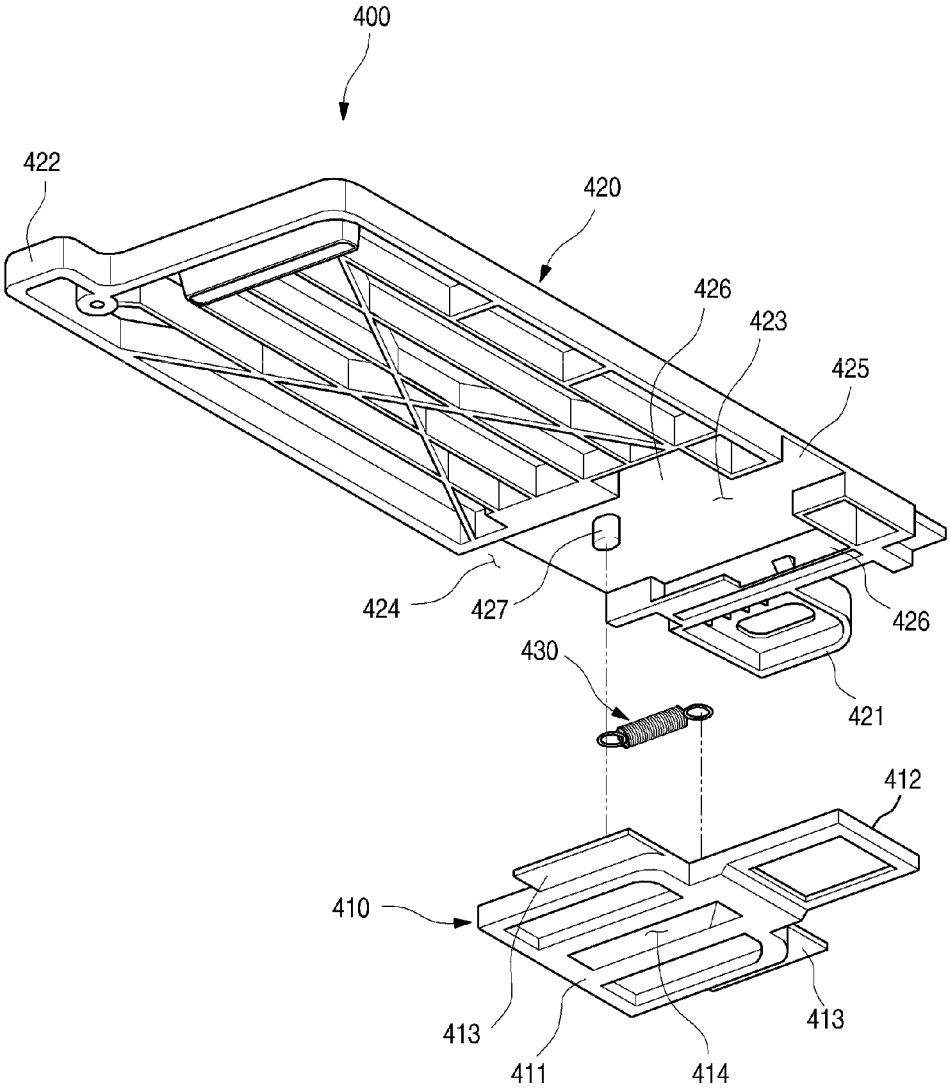
FIG. 9 is an exploded perspective view of the sub-module.

FIG. 8 is an exploded perspective view showing a coupling structure of the door and the sub-module of the door opening apparatus. Also, FIG. 9 is an exploded perspective view of the sub-module.

As shown in the drawings, a sub-module installation part 511 for installing the sub-module 400 may be formed at an upper end of the door 22, more particularly, at both sides of an upper surface of the door case 510. The sub-module installation part 511 may be formed behind the main module 300 and may include a region corresponding to where at least the main slider 390 is installed. Also, the sub-module installation part 511 may be stepped to have a depth corresponding to the depth of the sub-module 400. Accordingly, while the sub-module 400 is installed, the upper surface of the sub-module 400 is coplanar with the upper surface of the door 22. Thus, when viewed from the outside, the sub-module installation part 511 may prevent the sub-module 400 from being easily recognized.

Also, the sub-module 400 may include the sub-slider 410, the slider cover 420, and a slider elastic-member 430.

The sub-slider 410 may have a size that can be received inside the sub-module installation part 511 and may be placed on the same extension line so that the sub-slider 410 can be in contact with the main slider 390. Also, along with the movement of the main slider 390, the sub-slider 410 may have a size formed to selectively protrude to the rear surface of the door 22.

The sub-slider 410 may be composed of a slider front 411 being in contact with the main slider 390 and a slider rear 412 protruding outward from the door 22 and pushing the cabinet 10. The slider front 411 may be formed to have a greater width than the slider rear 412 so that the sub-slider 410 may be prevented from being removed from the slider cover 420.

A side rib 413 configured to protrude laterally may be provided at both left and right sides of the slider front 411. The side rib 413 may extend in a movement direction of the sub-slider 410 and may be formed to protrude from an upper end of the slider front 411. Also, the side rib 413 may be received in a side guide formed in the slider cover 420. Accordingly, the sub-slider 410 may be guided by the side rib 413 and the side guide 426 to move front and back.

Also, a guide hole 414, which is elongated in the moving direction of the sub-slider 410, may be opened at the center of the slider front 411. A second elastic-member fixing part 427, which will be described below, may be inserted into the guide hole 414.

A first elastic-member fixing part 415 may be formed behind the guide hole 414. The first elastic-member fixing part 415 may be formed to fix one end of the slider elastic-member 430.

The slider elastic-member 430 may be placed inside the guide hole 414, and along with the movement of the sub-slider 410, the slider elastic-member 430 may provide an elastic force and return to its original position.

The slider elastic-member 430 may have a structure such as a tension spring and have an end fixed to the first elastic-member fixing part 415 of the sub-slider 410 and the other end fixed to the second elastic-member fixing part 427 formed in the slider cover 420. Accordingly, when the sub-slider 410 moves backward and protrudes outward from the door, the slider elastic-member 430, the slider elastic-member 430 may be tensioned. Thus, the elastic force may allow the sub-slider 410 to move forward to its original position.

The slider cover 420 may be configured to shield the sub-module installation part 511. While installed in the sub-module installation part 511, the slider cover may be formed to receive the sub-slider 410. Also, while installed in the sub-module installation part 511, the slider cover 420 may form an upper surface of the door 22 and may form the same plane as the upper surface of the door.

A cover fixing part 421, to which a screw is to be fastened, may be formed on one side of the slider cover 420 to protrude laterally. Also, a stepped part 422 may be formed such that the other side of the slider cover 420 can be matched to an upper end of a side surface of the door 22.

A slider installation part 423, into which the sub-slider 410 is to be inserted, may be formed on the bottom surface of the slider cover 420. The slider installation part 423 may be recessed in a corresponding shape such that the sub-slider 410 can be received, and may be opened front and back.

The slider installation part 423 may be composed of an entrance part 424 in which the slider front 411 is received and an exit part 425 in which the slider rear 412 is received. The entrance part 424 and the exit part 425 may be formed to have widths corresponding to the slider front 411 and the slider rear 412, respectively. Accordingly, the exit part 425 has a smaller width than the entrance part 424, and thus it is possible to prevent removal of the slider installation part 423 when the slider installation part 423 is moving.

Also, the side guide 426 may be formed at both ends of the inner side of the entrance part 424. The side guide 426 may be recessed outward to receive the side rib 413 and may guide movement of the side rib 413 as the sub-slider 410 moves front and back. Also, a hook engaging the side rib may be further formed in the side guide 426 in order to prevent removal of the sub-slider 410.

Also, a second elastic-member fixing part 427 protruding downward may be formed in the entrance part 424. The second elastic-member fixing part 427 may fix one end of the slider elastic-member 430 and may be placed in front of the first elastic-member fixing part 415. The slider elastic-member 430 may connect the sub-slider 410 and the slider cover 420 and may provide an elastic force to the sub-slider 410 moving forth and back.

A plurality of reinforcing ribs 315 for reinforcing intensity of the slider cover 420 may be horizontally, vertically, and diagonally formed on the rear surface of the slider cover 420.

The operation of the door opening apparatus according to an embodiment of the present invention having the above structure will be described below in detail with reference to the drawings.

Figure 10:
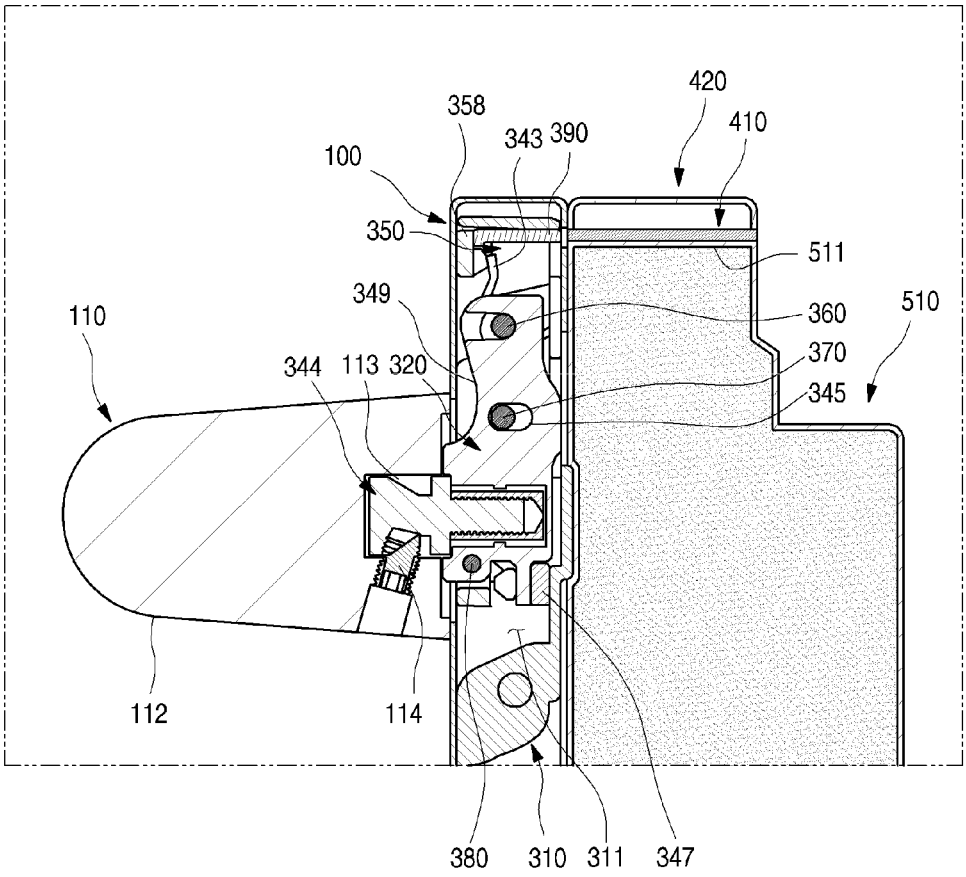
FIGS. 10 and 11 are sectional views showing the state of the door opening apparatus before a door handle of the door is operated.
Figure 11:
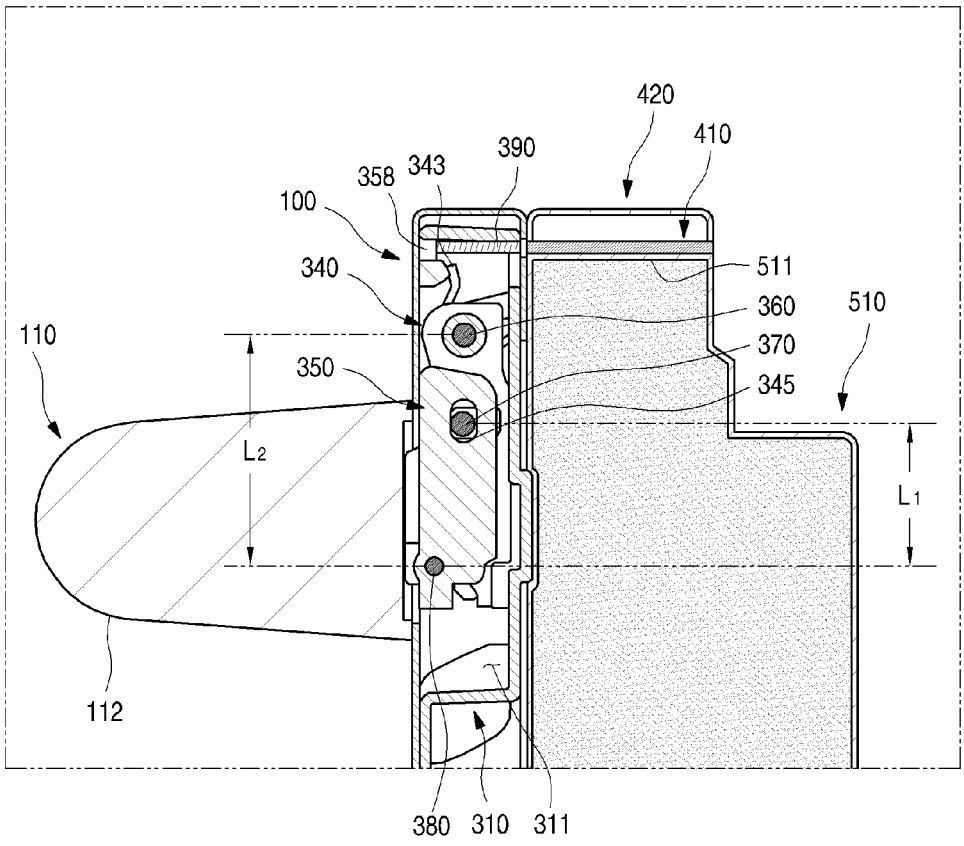

FIGS. 10 and 11 are sectional views showing the state of the door opening apparatus before a door handle of the door is operated.

As shown in the drawings, before a user operates the door handle 110 while the door 22 is closed, the door handle 110 is not rotated, that is, maintains the state shown in FIG. 3. Also, the door opening apparatus 200 maintains the state shown in FIGS. 10 and 11.

In detail, the door handle 110 does not provide an external force to the first rotator 340 of the main module 300 while no external force is applied to the door handle 110. Since no external force is applied to the elastic member 343, the first rotator 340 are received into the module case 310 while perpendicular to the front surface of the panel 100 as shown in FIG. 10. Since the first rotator 340 is not rotated, the second rotator 350 is not rotated as shown in FIG. 11.

Also, in this case, the second shaft 370 is placed at a front portion of the first elongated hole 345 and at a lower end of the second elongated hole 356, and thus maintains a rotatable state.

Also, while the second rotator 350 does not rotate, the push part 358 of the second rotator 350 is placed in front of the module case 310. Accordingly, the main slider 390 in contact with the push part 358 is placed at the frontmost position. In this case, the main slider 390 is received inside the module case 310 such that the sub-slider 410 cannot be substantially pushed. Accordingly, the sub-slider 410 may be placed inside the slider cover 420 and at the frontmost position.

In this situation, the user may grasp and pull the door handle 110 when he or she wants to open the door 22. The door handle 110 may be placed above the door 22 and may naturally rotate a predetermined angle when the door handle 110 is pulled to operate the door opening apparatus 200.

Figure 12:
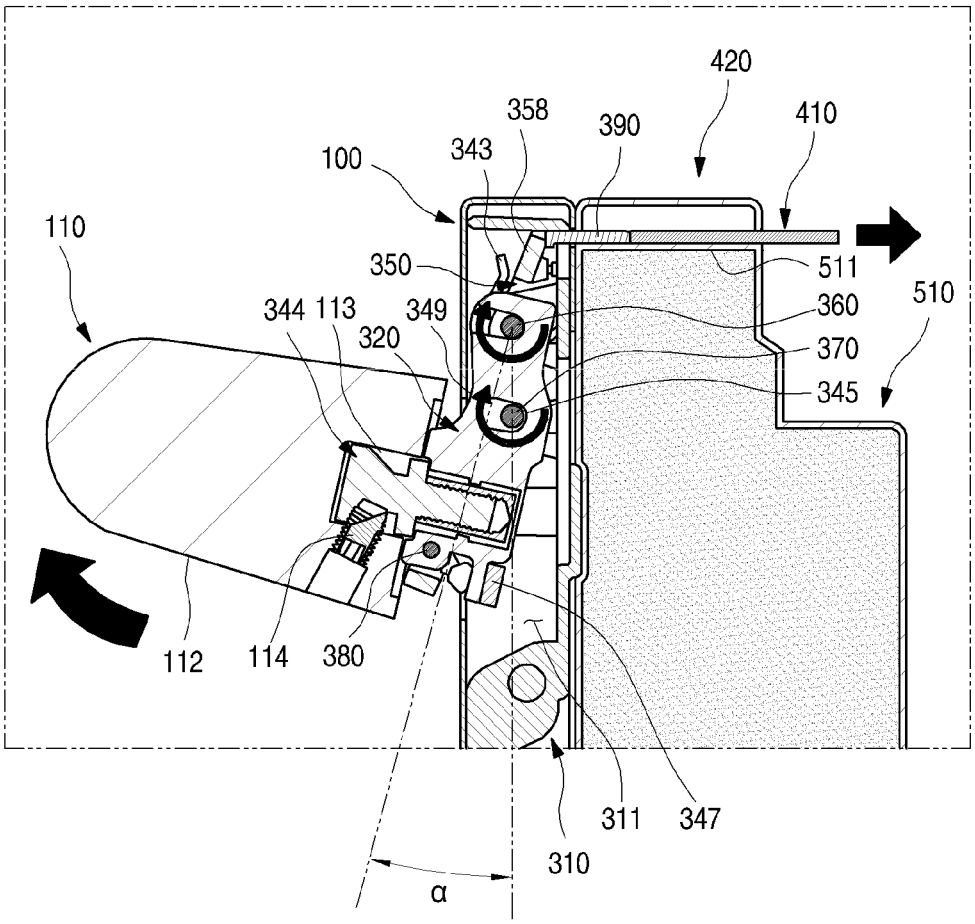
FIGS. 12 and 13 are sectional views showing the state of the door opening apparatus before a door handle of the door is operated.
Figure 13:
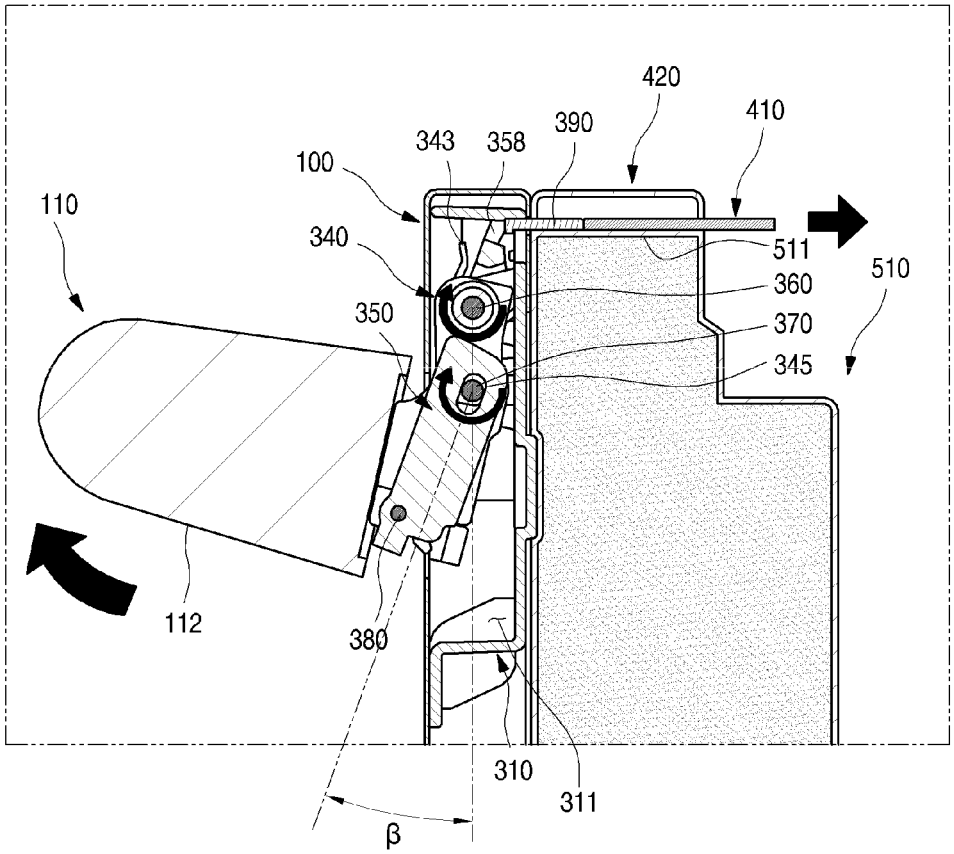

FIGS. 12 and 13 are sectional views showing the state of the door opening apparatus before the door handle of the door is operated.

As shown in the drawings, when a user grasps and pulls the door handle 110, the first rotator 340 coupled to the door handle 110 rotates as shown in FIG. 12.

The first rotator 340 rotates clockwise about the first shaft 360 according to the operation of the door handle 110. The second rotator 350 may also rotate because the first rotator 340 is coupled to the second rotator 350 by the third shaft 380. In this case, the second rotator 350 rotates about the second shaft 370.

Specifically, the first rotator 340 rotates about the first shaft 360, and the second shaft 370 moves from a front end of the first elongated hole 345 to a rear end of the first elongated hole 345. That is, the rotation of the first rotator 340 may be limited by the first elongated hole 345. When the first rotator 340 is maximally rotated, the first rotator 340 becomes a state shown in FIG. 12. In this case, the first rotator 340 rotates a first angle $\alpha$ about the first shaft 360.

Since the first shaft 360 is provided at an upper end of the first rotator 340, the handle door 22 may also substantially rotate the first angle $\alpha$. That is, the user operates the handle door 22 to rotate the first angle $\alpha$ in order to open the door 22.

The second rotator 350 may rotate in conjunction with the first rotator 340 when the first rotator 340 rotates. In this case, the second shaft 370, which is a rotational shaft, vertically moves along the second elongated hole 356. The second rotator 350 rotates until the second shaft 370 is placed at an upper end of the second elongated hole 356 as shown in FIG. 13.

When the second rotator 350 rotates, the elastic member 343 may be tensioned, thus generating an elastic force. When the second rotator 350 is rotated as shown in FIGS. 12 and 13, the maximum elastic force is applied to the elastic member 343.

The second rotator 350 may rotate until the second shaft 370 moves to the upper end of the second elongated hole 356 and thus no longer moves. In this case, the second rotator 350 may rotate a second angle $\beta$ about the second shaft 370.

In this case, the forces of the first rotator 340 and the second rotator 350 are applied to the same action point, that is, the third shaft 380, but the centers of rotation are placed at different portions. That is, the second shaft 370, which is the center of rotation of the second rotator 350, is placed lower than the first shaft 360, which is the center of rotation of the first rotator 340. Accordingly, the first shaft 360 and the second shaft 370 rotate at the same time, but the second angle $\beta$ rotated by the second shaft 370 may be greater than the first angle $\alpha$.

End portions of the first rotator 340 and the second rotator 350 are coupled to each other by the third shaft 380. Accordingly, when a user rotates the first rotator 340 by rotating the door handle 110 by the first angle $\alpha$, the second rotator 350 may rotate the second angle $\beta$, which is greater than that of the first rotator 340.

Accordingly, even when the first rotator 340 rotates a small angle while the module case 310 is thin, the second rotator 350 may rotate a sufficient rotation angle to secure a movement distance of the main slider 390. That is, it is possible to install the door opening apparatus 200 even in the panel 100 with a small thickness and facilitate opening of the door 22.

The position of the second shaft 370 may be determined such that a ratio of distance L1, which is a distance from a lower end of the third shaft 380 to the second shaft 370, to distance L2, which is a distance from a lower end of the third shaft to the first shaft 360, is approximately 2:3. Accordingly, it is possible to secure a draw-out distance of the main slider 390 needed to open the door 22 when the second rotator 350 rotates.

In detail, when the first rotator 340 and the second rotator 350 are rotated by the operation of the door handle 110 as shown in FIG. 12, the push part 358 at an upper end of the second rotator 350 pushes a front end of the main slider 390. Accordingly, the main slider 390 may be moved to the rearmost position.

As the main slider 390 moves backward, the sub-slider 410 may also move backward. In this case, the slider elastic-member 430 may be tensioned. The sub-slider 410 may protrude backward from the door 22 to push a front surface of the cabinet 10 so that the door 22 may be easily opened.

When the door handle 110 is released while the door 22 is opened, an elastic restoring force of the slider elastic-member 430 may return the second rotator 350 and the sub-slider 410 to their initial positions, as shown in FIGS. 11 and 12.

In this case, the first rotator 340 coupled to the second rotator 350 rotates counterclockwise and returns to its original position by the elastic force of the elastic member 343 applied to the second rotator 350.

When the sub-slider 410 moves forward by the elastic force of the elastic member 343 while the main slider 390 is in contact with the sub-slider 410, the main slider 390 also moves forward and returns to its original position.

Meanwhile, for the refrigerator and the refrigerator door opening apparatus described herein, various other embodiments are possible in addition to the aforementioned embodiments. In the aforementioned embodiments, the refrigerator door opening apparatus has a structure provided in a panel and a door of a built-in refrigerator. However, according to another embodiment of the present invention, the door opening apparatus is provided in a door of a typical refrigerator other than a built-in refrigerator.

In other embodiments of the present invention, the basic structure of the door opening apparatus is the same, but there is only a difference between objects to which the door opening apparatus is provided. The same reference numerals are used for the same components, and detailed description and illustration thereof will be omitted.

Figure 14:
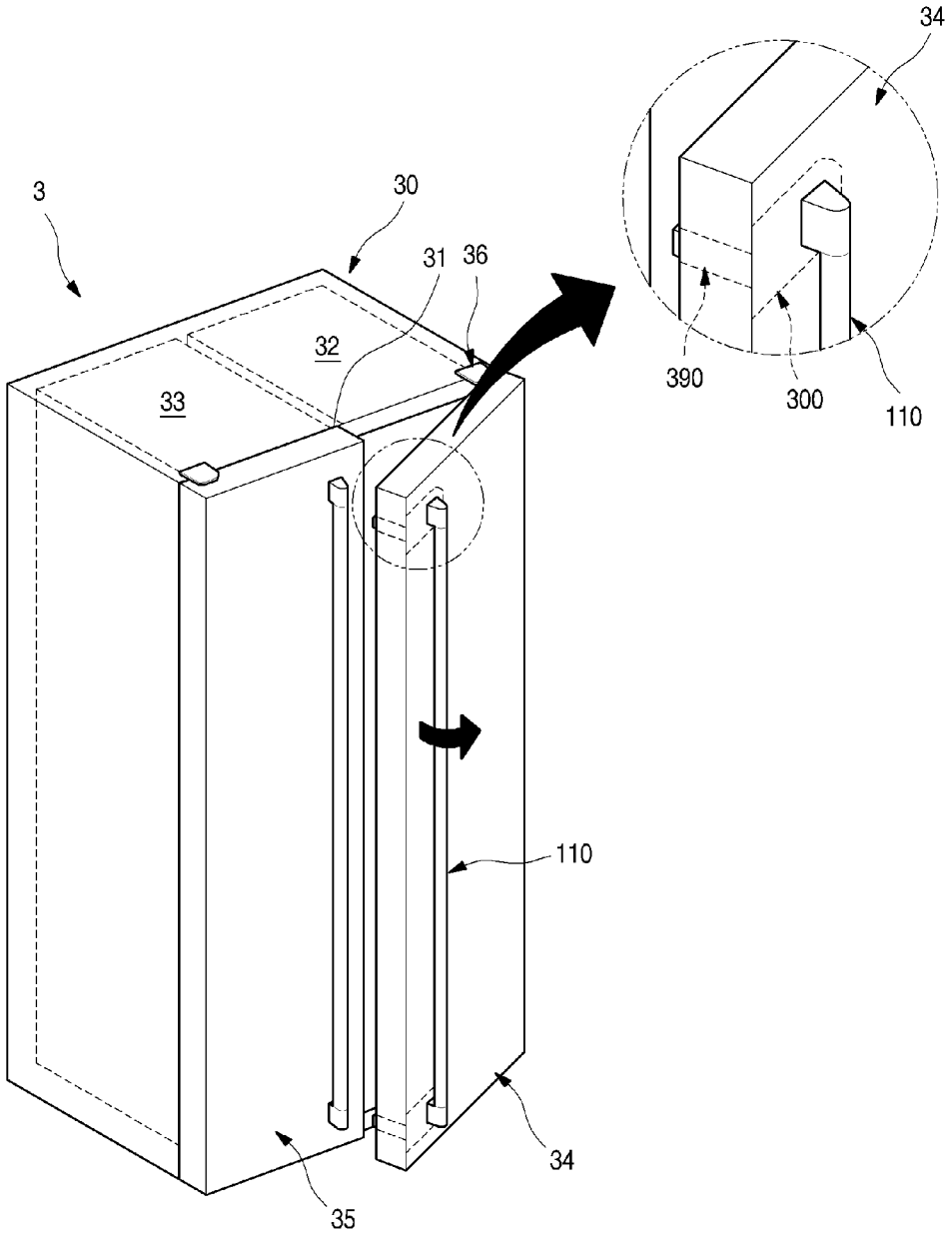
FIG. 14 is a perspective view of a refrigerator with a door being open according to an embodiment of the present invention.

FIG. 14 is a perspective view of a refrigerator with a door being open according to an embodiment of the present invention.

As shown in the drawing, a refrigerator 3 according to another embodiment of the present invention may have an exterior appearance formed by a cabinet 30 forming a storage space and doors 34 and 35 rotatably installed in the cabinet 30.

A barrier 31 may be provided in the cabinet 30, and the storage space is divided into two partitions by the barrier 31 to form a refrigerating chamber 32 and a freezing chamber 33. Also, the doors 34 and 35 may be configured as a refrigerating chamber door 34 for opening and closing the refrigerating chamber 32 and a freezing chamber door 35 for opening and closing the freezing chamber 33, respectively. The refrigerating chamber door 34 and the freezing chamber door 35 may be installed in the cabinet 30 such that the doors can be rotated by a hinge device 36.

The door handle 110 may be provided on the front surface of each of the doors 34 and 35. The door handle 110 may be configured such that a user can grasp and pull a part separated from the front surface of each of the doors 34 and 35, and both ends of the door handle 110 may be connected to the door opening apparatus 300.

The door opening apparatus 300 may be provided inside the doors 34 and 35 and may be coupled to an end portion of the door handle 110 placed on the front surface of each of the doors 34 and 35. Also, the door opening apparatus 300 may have the same configuration as the main module 300 of the aforementioned embodiment and may have a structure in which, by pulling the door handle 110, the slider 390 protrudes to the rear surface of each of the doors 34 and 35 to push the cabinet 30 and open the doors 34 and 35. In this case, the slider 390 may be placed at side ends of the rear surfaces of the doors 34 and 35 and may be configured to protrude backward and come into contact with the barrier 31.

Figure 15:
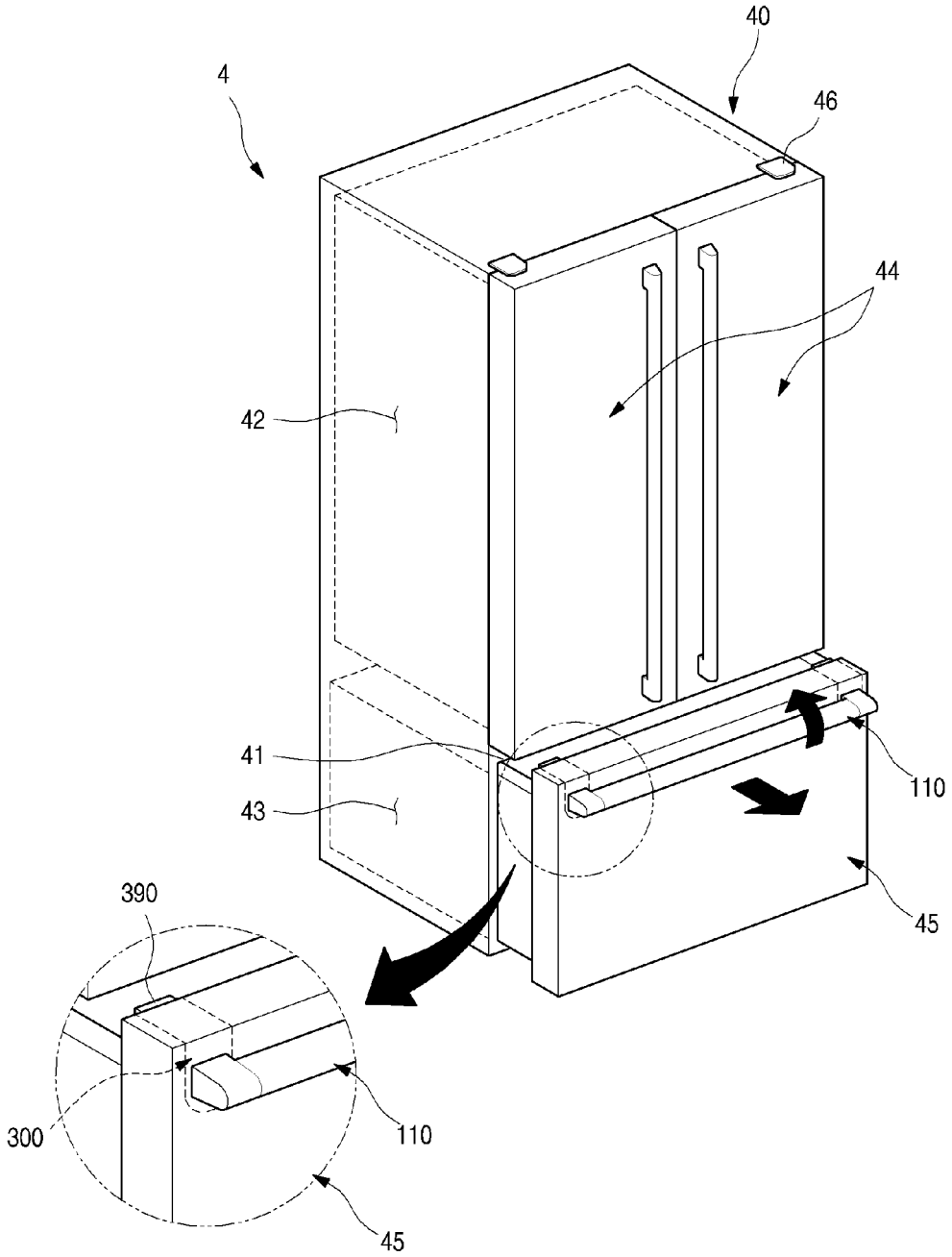
FIG. 15 is a perspective view of a refrigerator with a door being open according to still another embodiment.

FIG. 15 is a perspective view of a refrigerator with a door being open according to still another embodiment.

As shown in the drawing, a refrigerator 4 according to still another embodiment of the present invention may have an exterior appearance formed by a cabinet 40 forming a storage space and doors 44 and 45 rotatably installed in the cabinet 40.

A barrier 41 may be provided in the cabinet 40, and the storage space is divided into two partitions by the barrier 41 to form a refrigerating chamber 42 and a freezing chamber 43. Also, the doors 44 and 45 may be configured as a refrigerating chamber door 44 for opening and closing the refrigerating chamber 42 and a freezing chamber door 45 for opening and closing the freezing chamber 43, respectively. A pair of refrigerating chamber doors 44 may be provided at both left and right sides and may be rotatably installed in the cabinet 40 by a hinge device 46.

The freezing chamber door 45 may be opened and closed by sliding into or out of the freezing chamber 43 and may be formed to have a structure capable of draw-in or draw-out, such as a drawer. Also, a door handle 110 may be provided on the front surface of the freezing chamber door 45. The door handle 110 may be configured such that a user can grasp and pull a part separated from the front surface of each of the doors 44 and 45, and both ends of the door handle 110 may be connected to the door opening apparatus 300.

The door opening apparatus 300 may be provided inside the freezing chamber door 45 and may be coupled to an end portion of the door handle 110 placed on the front surface of the freezing chamber door 45. Also, the door opening apparatus 300 may have the same configuration as the main module 300 of the aforementioned embodiment and may have a structure in which, by pulling the door handle 110, the slider 390 protrudes to the rear surface of the freezing chamber door 45 to push the cabinet and open the freezing chamber door 45. In this case, the slider 390 may be placed at an upper end of the rear surface of the freezing chamber door 45 and may be configured to protrude backward and come into contact with the barrier 41.

The following effects can be expected in the refrigerator and the refrigerator door opening apparatus according to the proposed embodiment.

By providing the door opening apparatus to a built-in refrigerator, it is possible to facilitate opening of a door when a door handle is operated.

In particular, the door opening apparatus includes a main module coupled to the door handle in a panel installed in the door and a sub-module provided at a side of the door corresponding to the main module. Thus, when a user operates the door handle, the main module and the sub-module interoperate to push the cabinet and facilitate opening of the door.

Also, the door opening apparatus has a coupling structure of a first rotator in which the door handle is installed and a second rotator which pushes the slider and opens the door. In this case, the second rotator has a rotational shaft lower than that of the first rotator so that the second rotator rotates a large angle although the first rotator rotates a small angle. Therefore, even when the door handle is rotated by a small angle, it is possible to secure a sufficient movement distance of the slider to facilitate opening of the door.

With this structure, the door opening apparatus may be applied to the panel installed in the door of the built-in refrigerator, and the door opening apparatus may be installed without an increase in thickness of the panel.

Further, the door opening apparatus having such a structure may be applied to a door of a general refrigerator. In this case, it is possible to minimize the thickness of the door opening apparatus to prevent deterioration of the heat insulation performance of the door.

In addition, the first rotator may be received inside, and coupled to, the second rotator, thereby making the door opening apparatus slimmer.

Further, the door opening apparatus may have a structure that may be independently removable from the panel or the door. Accordingly, it is possible to determine whether to apply the door opening apparatus through selective installation without changing the structures of the panel and the door. Accordingly, the manufacturer may provide various selection options without changing the basic structure and may advantageously provide various selection options to the user.

It will be apparent to those skilled in the art that various modifications and variations can be made in the present invention without departing from the spirit or scope of the disclosures. Thus, it is intended that the present invention covers the modifications and variations of this disclosure provided they come within the scope of the appended claims and their equivalents.

What is claimed is:

1. A refrigerator comprising:

a cabinet that defines a storage space;

a door configured to open and close at least a portion of the storage space;

a panel coupled to a front surface of the door, the panel defining an external appearance of the door;

a door handle located at the panel; and a door opening apparatus coupled to the door handle and configured to assist opening of the door, the door opening apparatus comprising:

a main module that is located inside of the panel and that is configured to protrude from the panel toward the door based on rotation of the door handle relative to the panel, and a sub-module that is located rearward of the main module at an end portion of the door, that is configured to protrude toward the storage space in a state in which the main module protrudes toward the door, and that is configured to push the cabinet to assist opening of the door, wherein the main module comprises:

a first rotator coupled to the door handle, the first rotator having an upper end that is configured to couple to an inside of the panel and that is configured to rotate by a first angle about a first rotational shaft that extends along the inside of the panel, and a second rotator that is coupled to the first rotator at a position vertically below the first rotational shaft, that is configured to rotate in a state in which the first rotator rotates about the first rotational shaft, and that is configured to rotate by a second angle about a second rotational shaft disposed vertically below the first rotational shaft, the second angle being greater than the first angle, wherein the first rotator defines a first elongated hole that is configured to receive the second rotational shaft and that is configured to limit rotation of the first rotator, and wherein the second rotator defines a second elongated hole that is configured to receive the second rotational shaft and that is configured to limit rotation of the second rotator.

2. The refrigerator of claim 1, wherein the panel defines:

a panel opening that is located at a side of the panel at a position corresponding to the door handle; and an installation part that communicates with the panel opening, that is located at a rear surface of the panel, and that is configured to receive the main module.

3. The refrigerator of claim 1, wherein the main module further comprises:

a main slider that is configured to contact an upper end of the second rotator and that is configured to, based on rotation of the second rotator, protrude from the panel toward the door.

4. The refrigerator of claim 1, wherein the second rotator further defines a rotator receiving space configured to receive the first rotator, and wherein the first rotator is configured to rotate together with the second rotator in a state in which the first rotator is received in the rotator receiving space.

5. The refrigerator of claim 4, wherein the second rotational shaft passes through both of the first rotator and the second rotator.

6. The refrigerator of claim 3, wherein the main module further comprises a module case that is located inside of the panel and that is configured to receive the first rotator, the second rotator, and the main slider.

7. The refrigerator of claim 1, wherein the sub-module comprises:

a sub-slider that is located at a side end of the door, that is configured to selectively protrude toward the storage space based on the main module protruding toward the door, and that is configured to push the cabinet based on the sub-slider protruding toward the storage space; and a slider cover that is located at the door, that is configured to cover the sub-slider, and that defines at least a portion of the external appearance of the door.

8. The refrigerator of claim 7, wherein the sub-module further comprises a slider elastic-member that is coupled to the sub-slider and the slider cover and that is configured to provide elastic force to the sub-slider based on movement of the sub-slider relative to the door.

9. The refrigerator of claim 7, wherein the slider cover defines a slider installation part that allows insertion of the sub-slider to the slider cover and protrusion of the sub-slider outward from the slider cover, wherein the slider installation part has an entrance through which the sub-slider is configured to insert to the slider cover, and an exit through which the sub-slider is configured to protrude outward from the slider cover, and wherein the entrance and the exit have different widths.

10. A refrigerator comprising:

a cabinet that defines a storage space;

a door configured to open and close at least a portion of the storage space;

a door opening apparatus located at the door and configured to assist opening of the door; and a door handle connected to the door opening apparatus, wherein the door opening apparatus comprises:

a first rotator coupled to the door handle, the first rotator having an upper end that is coupled to an inside of the door and that is configured to rotate by a first angle about a first rotational shaft that extends along the inside of the door, a second rotator that is coupled to the first rotator at a position vertically below the first rotational shaft, that is configured to rotate in a state in which the first rotator rotates about the first rotational shaft, and that is configured to rotate about a second rotational shaft by a second angle that is greater than the first angle, and a slider that is configured to contact an upper end of the second rotator and that is configured to, based on rotation of the second rotator, protrude from the door toward the storage space, wherein the first rotator defines a first elongated hole that is configured to receive the second rotational shaft and that is configured to limit rotation of the first rotator, and wherein the second rotator defines a second elongated hole that is configured to receive the second rotational shaft and that is configured to limit rotation of the second rotator.

11. The refrigerator of claim 10, wherein the second rotator defines a receiving space configured to receive the first rotator at an inside of the second rotator, and wherein the first rotator is coupled to a lower end of the second rotator in the inside of the receiving space.

12. A refrigerator door opening apparatus comprising:

a module case that defines a recessed space;

a first rotator that is located inside the module case, that is configured to couple to a door handle of a refrigerator, and that is configured to rotate relative to the module case based on operation of the door handle;

a first shaft that passes through an upper end of the first rotator, the first rotator being configured to rotate about the first shaft by a first angle;

a second rotator that is coupled to a lower end of the first rotator, that is configured to rotate in a state in which the first rotator rotates about the first shaft, and that is configured to rotate about an axis by a second angle that is greater than the first angle, the second rotator extending vertically above the first rotator;

a second shaft that passes through the second rotator at a position vertically below the first shaft and that extends along the axis, the second rotator being configured to rotate about the second shaft; and a slider that is supported by an upper end of the second rotator, that is located inside of the module case, and that is configured to, based on rotation of the second rotator, push a cabinet of the refrigerator to assist opening of a door of the refrigerator, wherein the first rotator defines a first elongated hole that is configured to receive the second shaft and that is configured to limit rotation of the first rotator, and wherein the second rotator defines a second elongated hole that is configured to receive the second shaft and that is configured to limit rotation of the second rotator.

13. The refrigerator door opening apparatus of claim 12, wherein the module case comprises:

a pair of first shaft support parts that protrude from a recessed surface of the module case, that are spaced apart from each other, and that are configured to support both ends of the first shaft, respectively; and a pair of second shaft support parts that protrude from the recessed surface of the module case, that are spaced apart from each other, and that are configured to support both ends of the second shaft, respectively, and wherein the pair of second shaft support parts are located vertically below the pair of first shaft support parts.

14. The refrigerator door opening apparatus of claim 13, wherein the second rotator defines a receiving space configured to receive the first rotator in the second rotator, and wherein the first rotator is coupled to the second rotator based on the first rotator being received in the receiving space.

15. The refrigerator door opening apparatus of claim 14, wherein the second shaft passes through the pair of second shaft support parts, the second rotator, and the first rotator.

16. The refrigerator door opening apparatus of claim 15, wherein the first elongated hole extends in a horizontal direction, and wherein the second elongated hole extends in a vertical direction.

17. The refrigerator door opening apparatus of claim 14, further comprising a third shaft that passes through a lower end of the first rotator and a lower end of the second rotator, wherein the first rotator and the second rotator are rotatably coupled to the third shaft.

18. The refrigerator door opening apparatus of claim 14, further comprising an elastic member located at the first shaft and configured to provide elastic force to the first rotator based on rotation of the first rotator.

19. The refrigerator door opening apparatus of claim 14, wherein the receiving space comprises:

an upper receiving part that is an opening configured to receive the first shaft that passes through the pair of first shaft support parts and the first rotator; and a lower receiving part that extends downward from a center of the upper receiving part and that is configured to receive the first rotator.

20. The refrigerator door opening apparatus of claim 19, wherein the lower receiving part is located between the pair of second shaft support parts, and wherein the second shaft is configured to insert to one of the pair of second shaft support parts to sequentially pass through the lower receiving part and the first rotator.

* * * * *